US011104481B2

(12) United States Patent
Close

(10) Patent No.: US 11,104,481 B2
(45) Date of Patent: Aug. 31, 2021

(54) RIGID TRAY CONTAINER AND METHOD OF USE

(71) Applicant: United States Postal Service, Washington, DC (US)

(72) Inventor: Donald R. Close, Fairfax, VA (US)

(73) Assignee: United States Postal Service, Washington, DC (US)

( * ) Notice: Subject to any disclaimer, the term of this patent is extended or adjusted under 35 U.S.C. 154(b) by 0 days.

(21) Appl. No.: 16/696,778

(22) Filed: Nov. 26, 2019

(65) Prior Publication Data

US 2020/0095020 A1 Mar. 26, 2020

Related U.S. Application Data

(60) Continuation of application No. 15/608,646, filed on May 30, 2017, now Pat. No. 10,518,934, which is a (Continued)

(51) Int. Cl.

| | |
|---|---|
| ***B65D 21/04*** | (2006.01) |
| ***B65B 5/06*** | (2006.01) |
| ***B65D 19/38*** | (2006.01) |
| ***B07C 5/34*** | (2006.01) |
| ***B07C 3/00*** | (2006.01) |
| ***B65D 21/02*** | (2006.01) |
| ***B65D 21/06*** | (2006.01) |
| ***B65D 25/20*** | (2006.01) |
| ***B65D 25/28*** | (2006.01) |
| ***B65D 1/46*** | (2006.01) |
| ***B07C 99/00*** | (2009.01) |
| ***B65B 57/02*** | (2006.01) |

(52) U.S. Cl.

CPC ..... *B65D 21/045* (2013.01); *B07C 3/005* (2013.01); *B07C 5/3412* (2013.01); *B07C 9/00* (2013.01); *B65B 5/06* (2013.01); *B65B 57/02* (2013.01); *B65D 1/46* (2013.01); *B65D 19/385* (2013.01); *B65D 21/0212* (2013.01); *B65D 21/0223* (2013.01); *B65D 21/064* (2013.01); *B65D 25/205* (2013.01); *B65D 25/2888* (2013.01); *B65D 21/0217* (2013.01); *B65D 25/2808* (2013.01); *B65D 2203/02* (2013.01); *B65D 2203/10* (2013.01)

(58) Field of Classification Search

None

See application file for complete search history.

(56) References Cited

U.S. PATENT DOCUMENTS 2,774,511 A 12/1956 Menkin et al.
3,447,699 A * 6/1969 Weir ..... B65G 1/1378 414/285

(Continued)

*Primary Examiner* — William R Harp

(74) *Attorney, Agent, or Firm* — Knobbe Martens Olson & Bear LLP

(57) ABSTRACT

Embodiments of this disclosure include a rigid tray container and methods and equipment for using the rigid tray container in batched process operations. In one embodiment, a mass container is sized and dimensioned to receive one or several rigid tray containers. In other embodiments, equipment is configured to lid/unlid, secure, stack, load/unload, and buffer rigid tray containers. In other embodiments, equipment is configured to stack and stage mass containers. In some embodiments, methods are provided for batch processing items.

14 Claims, 28 Drawing Sheets

Related U.S. Application Data continuation of application No. 14/673,529, filed on Mar. 30, 2015, now Pat. No. 9,862,522, which is a division of application No. 13/791,788, filed on Mar. 8, 2013, now Pat. No. 9,284,093.

(56) References Cited

U.S. PATENT DOCUMENTS

| | | | | | |
|---|---|---|---|---|---|
| 4,285,624 | A * | 8/1981 | Propst | B65F 1/122 | 220/832 |
| 4,799,603 | A | 1/1989 | Dudzik | | |
| 5,406,770 | A | 4/1995 | Fikacek | | |
| 5,503,275 | A | 4/1996 | Fesquet | | |
| 5,577,613 | A | 11/1996 | Laidlaw | | |
| 6,131,757 | A * | 10/2000 | Clark | B65D 11/1833 | 220/4.28 |
| 6,419,074 | B1 | 7/2002 | Rasile et al. | | |
| 7,210,597 | B2 | 5/2007 | Enenkel et al. | | |
| 8,950,613 | B2 * | 2/2015 | Nolan | B65D 19/18 | 220/4.31 |
| 9,284,093 | B2 | 3/2016 | Close | | |
| 9,862,522 | B2 | 1/2018 | Close | | |
| 2003/0038065 | A1 | 2/2003 | Pippin et al. | | |
| 2004/0134753 | A1 | 7/2004 | Diego et al. | | |
| 2006/0043160 | A1 | 3/2006 | Clark | | |
| 2006/0180520 | A1 | 8/2006 | Ehrat et al. | | |
| 2007/0209976 | A1 | 9/2007 | Worth et al. | | |
| 2009/0194172 | A1 | 8/2009 | Lymn et al. | | |
| 2010/0147751 | A1 | 6/2010 | Pippin | | |
| 2013/0015183 | A1 * | 1/2013 | Fredette | B65D 88/522 | 220/6 |

* cited by examiner

RIGID TRAY CONTAINER AND METHOD OF USE

INCORPORATION BY REFERENCE TO ANY PRIORITY APPLICATIONS

Any and all applications for which a foreign or domestic priority claim is identified in the Application Data Sheet as filed with the present application are hereby incorporated by reference under 37 CFR 1.57. This application is a continuation of U.S. application Ser. No. 15/608,646, filed May 30, 2017, which is a continuation U.S. application Ser. No. 14/673,529, filed Mar. 30, 2015, which, in turn, is a divisional of U.S. application Ser. No. 13/791,788, filed Mar. 8, 2013 the entire contents all of which are hereby incorporated by reference in their entirety.

BACKGROUND OF THE DEVELOPMENT

Field of the Development

The present disclosure relates to the field of sorting, buffering or batching, and transport of items.

Description of the Related Art

A variety of containers are used in sorting and transport processes. These containers can have a variety of shapes and sizes. Some of these containers include sleeves, bags, pallets, hampers, cages, cartons, and tubs. The containers are made of a variety of different materials of different strengths. These different sizes and shape of containers, as well as the different materials used in making the container results in a wide range of container properties such as strength and weight. Because of these variations, handling procedures are complicated as each of the different containers can tolerate different degrees of loading and abuse.

Further, present sorting systems individually sort items. While this can be an effective process, it can create difficulties in production control and result in inefficiencies. In light of this, a sorting system and method are required that accelerate and standardize sorting processes while offering greater production control.

SUMMARY

Embodiments described herein include a stackable open ended rigid tray container for use with batch processing items or articles, for example, items of mail, the rigid tray container comprising a first side opposing a third side; a second side opposing a fourth side; a top comprising an indexing tab located proximal to the first side; a bottom, wherein the bottom comprises an exterior surface, wherein the exterior surface comprises an indexing cavity located proximal to the third side; wherein the features of the top and the bottom are configured for stacking rigid tray containers, wherein the indexing tab of a rigid tray container is configured for mating with the indexing cavity of another rigid tray container when the rigid tray containers are rotated relative to each other so as to position the first side of one of the rigid tray containers in proximity with the third side of the other rigid tray container.

In some embodiments, the bottom further comprises at least one indention configured to stabilize the rigid tray container during transport.

In some embodiments, the bottom further comprises a pattern of indentations configured to stabilize the rigid tray container during transport.

In some embodiments, the bottom comprises an interior surface having a plurality of linear protrusions.

In some embodiments, the plurality of linear protrusions extend perpendicularly from interior surface of the bottom.

In some embodiments, the top further comprises a top rim.

In some embodiments, the rigid tray container further comprises a lid dimensioned for placement within top rim.

In some embodiments, the top further comprises compliant features configured to securingly engage the lid.

In some embodiments, a label is affixed to the tray.

In some embodiments, the rigid tray container further comprises compliant features configured to securingly engage the label.

In some embodiments, the rigid tray container further comprises a security insert, wherein the security insert prevents removal of the lid without visibly affecting the security insert.

In some embodiments, the rigid tray container further comprises at least one handle.

In one aspect a method of batch processing articles utilizing a plurality of uniformly dimensioned trays, comprises transporting a plurality of articles contained in a tray to article processing equipment; processing the articles, placing the articles into one or more trays according to the processing results for the articles; categorizing the one or more trays according to processing results of the articles contained in the tray; placing the similarly categorized trays into a mass container loading apparatus; detecting the orientation of the similarly categorized trays placed into the mass container loading apparatus; adjusting the orientation of the similarly categorized trays; and loading similarly categorized trays into a mass container using the mass container loading apparatus.

In some embodiments, adjusting the orientation of the similarly categorized trays aligns an indexing tab on a first tray so it can engage with an indexing cavity on a second tray.

In some embodiments, the articles are removed from the tray before processing.

In some embodiments, the tray is identified at the processing equipment.

In some embodiments, the identification of the tray at the processing equipment identifies the articles in the tray.

In some embodiments, the articles are identified before placement into the tray.

In some embodiments, the tray is identified after receiving articles and the articles are associated with the tray identification.

In some embodiments, the trays are identified before loading into the container.

In some embodiments, the container is identified and the identification is associated with the loaded trays.

In some embodiments, the method comprises repeating the method to load a second container.

In some embodiments, the container and the second container are associated in a staging module.

In some embodiments, the identification of the staging module is associated with the container and the second container.

In another aspect, a mass container loading-unloading machine comprises a receiving area configured to receive a tray; a detector configured to detect the orientation of the tray inserted into the receiving area; a container rotator configured to rotate the tray based on input from the detector; a container aligner configured to align the tray as needed for further processing; a container shuttle configured to receive the tray from the container aligner, and load the tray into a mass container; and wherein the mass container is removable from the mass container loading-unloading machine so as to enable loading or unloading of multiple mass containers.

BRIEF DESCRIPTION OF THE DRAWINGS

The foregoing and other features of the present disclosure will become more fully apparent from the following description and appended claims, taken in conjunction with the accompanying drawings. Understanding that these drawings depict only several embodiments in accordance with the disclosure and are not to be considered limiting of its scope, the disclosure will be described with additional specificity and detail through use of the accompanying drawings.

DETAILED DESCRIPTION

Figure 1:
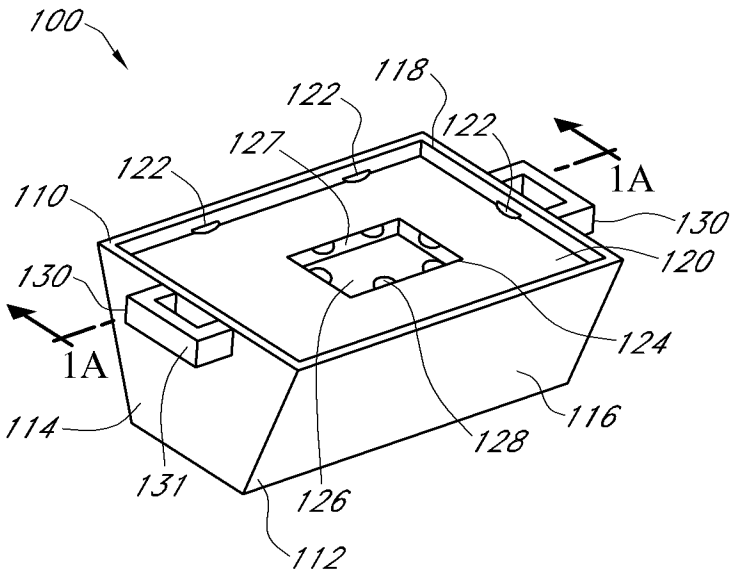
FIG. 1 depicts a perspective view of one embodiment of a rigid tray container.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here. It will be readily understood that the aspects of the present disclosure, as generally described herein, and illustrated in the Figures, can be arranged, substituted, combined, and designed in a wide variety of different configurations, all of which are explicitly contemplated and make part of this disclosure.

Some embodiments disclosed herein relate generally to a rigid tray container configured for use with item delivery. In some embodiments, the rigid tray container can be configured for use in connection with batch processing. In some embodiments, a rigid tray container can be used, for example, in connection with batch processing of items, such as, for example, letters, flats, packages, or other items. In some embodiments, batch processing can be accomplished in connection with the use of at least one rigid tray container. In some embodiments the trays can stack or nest. In some embodiments the rigid tray containers can be stacked with or without lids. Some embodiments disclosed herein relate to mass containers configured for holding and transport of at least one rigid tray container. In some embodiments, mass containers can be configured for use in batch processing of any item, including in connection with batch processing of articles. Some embodiments disclosed herein relate to apparatus configured for use in manipulating rigid tray containers. In some embodiments, the manipulations of a rigid tray container can include rotation, displacement, affixation, removal, loading, and unloading. In some embodiments, the manipulations can include loading a rigid tray container into a mass container or unloading a rigid tray container from a mass container. However, a person skilled in the art, having the instant specification, will appreciate that the rigid tray containers, the mass container, the manipulation apparatus, methods of bulk processing, and other subjects disclosed herein can be used in diverse ways.

Rigid Tray Container

FIG. 1 depicts one embodiment of a rigid tray container 100. A rigid tray container 100 can comprise a variety of shapes and sizes. In some embodiments, and as shown in FIG. 1, a rigid tray container 100 can have a top 110, a bottom 112, a first side 114, a second side 116, a third side (not shown), and a fourth side (not shown). In some embodiments, the top 110 and the bottom 112 each define a plane, which planes can be, for example, parallel, or non-parallel. In some embodiments, the opposing sides of the rigid tray container 100 similarly define parallel or non-parallel planes. Thus, in one embodiment, the first side 114 and the second side each define a plane, which planes can be parallel or non-parallel. Similarly, in one embodiment of the rigid tray container, the second side 116 and the fourth side each define a plane, which planes can be parallel or non-parallel. The rigid tray container 100 can be made of a variety of materials, such as, for example, metal, wood, paper product, plastic, polymer, composite material, natural material, synthetic material, or any other desired material having suitable physical properties. A person of skill in the art will recognize that the rigid tray container 100 is not limited to the specific shape and features depicted in FIG. 1 or described herein.

The rigid tray container 100 can be sized and dimensioned as required for a desired functionality. In some embodiments, a rigid tray container can be configured to hold a variety of items or articles, including a variety of mail pieces. In some embodiments, the rigid tray container 100 can be configured to hold, for example, 10, 25, 50, 56, 100, 250, 313, 500, 1,000, or any other desired number of flats and/or letters.

In some embodiments, the top 110 of the rigid tray container 100 can include features configured and dimensioned to facilitate closing of the rigid tray container 100, stacking, or nesting of the rigid tray container 100, or identifying the rigid tray container 100. In some embodiments, these, and other features, can, for example, facilitate the stacking of up to 100 rigid tray containers, up to 50 rigid tray containers, up to 25 rigid tray containers, up to 15 rigid tray containers, up to 5 rigid tray containers, or up to any other number of rigid tray containers. In some embodiments, for example, and as depicted in FIG. 1, the top 110 of the rigid tray container 100 can include a top receiving area 118.

Figure 1A:
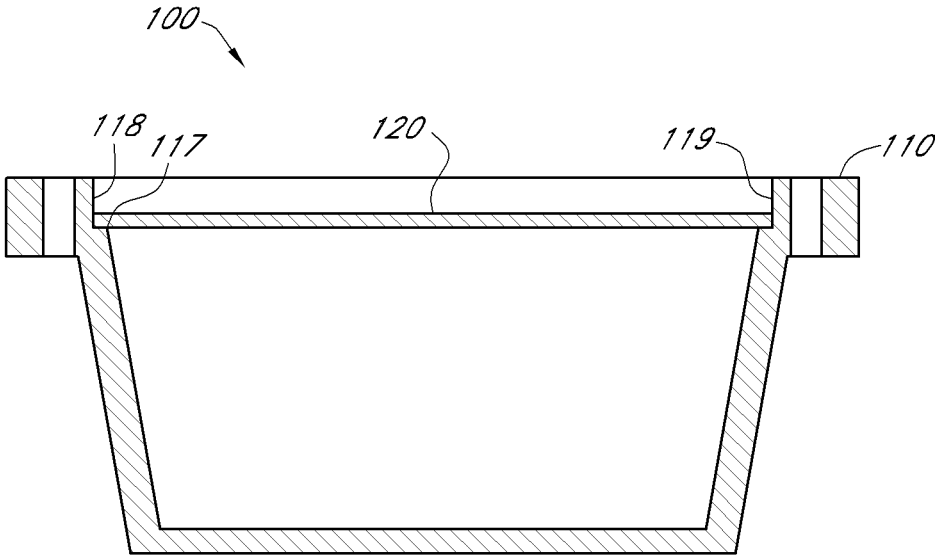
FIG. 1A depicts a cross-sectional view of one embodiment of a rigid tray container.

FIG. 1A is a cross-sectional side elevation view of the embodiment of the rigid tray container 100 shown in FIG. 1 taken along plane A. As seen in FIG. 1A, the top receiving area 118 is located in portions of the rigid tray container 100 proximate to the top 110 of the rigid tray container. As also send in FIG. 1A, the top receiving area 110 extends completely around the inner perimeter of the portions of the rigid tray container 100 proximate to the top 110.

The top receiving area 118 comprises a lip 117 and wall 119. In some embodiments, the lip 117 can comprise a surface configured for abutting contact with, for example, a lid, or the bottom 112 of a stacked rigid tray container 100. The lip 117 can define a plane which can be parallel with the planes defined by the top 110 and/or bottom 112 of the rigid tray container 100, or allow nesting when rotated 180 degrees end to end. In some embodiments, the lip 117 is sized to provide sufficient strength to withstand loads placed upon the lip 117 when a plurality of rigid tray containers 100 are stacked directly on the lip 117 or on top of the lid which is on the lip 117.

The top receiving area 118 can additionally comprise a wall 119. In some embodiments the wall extends from the outermost edge of the lip 117 to the top 110 of the rigid tray container 100. The wall 119 can be perpendicular or non-perpendicular with the plane defined by the top 110 of the rigid tray container 100. In some embodiments, the wall 119 and the lip 117 are sized and configured to allow a lid or the bottom of a rigid tray container 100 to fit within the top receiving area 118 and be in abutting contact with the lip. In some embodiments, portions or all of the wall may likewise be in abutting contact with a portion of the lid or of the stacked rigid tray container 100. A person of skill in the art will recognize that the dimensions and placement of the wall 119, the lip 117, and the top receiving area 118 can be varied according to the specific needs of a given application, and, for example, the desired tightness of the mating between stacking elements, the strength of the materials of both stacking elements, and the size and weight of the stacking elements.

Referring again to FIG. 1, in some embodiments of the rigid tray container 100, the top 110 can be configured for connection with a lid 120. As depicted in FIG. 1A, and as discussed above, the lid 120 can be dimensioned and shaped to fit within the top receiving area 118 of the rigid tray container 100. The lid 120 can be made of a variety of materials and in a variety of shapes and sizes. In some embodiments, the dimensions of the lid 120 can be configured to match certain dimensions of the rigid tray container 100 to thereby allow use of the lid 120 with the rigid tray container.

In some embodiments, the lid 120 is a single piece that substantially closes the rigid tray container 100. In some embodiments, the lid is a plurality of pieces that together substantially close the rigid tray container 100. In some embodiments, the lid 120 is a non-solid piece, such as, for example, a lattice, a net, or a mesh. In embodiments, in which the rigid tray container 100 is configured for use with a lid 120, one or both of the rigid tray container 100 or the lid 120 can include features to secure the lid 120 to the rigid tray container 100. In some embodiments, one of the rigid tray container 100 or the lid 120 includes at least one securing feature, such as, for example, at least one tie point, at least one snap, at least one latch, at least one detent, at least one clip, at least one spring device, or any other securing feature. The rigid tray container 100 depicted in FIG. 1 includes six detents 122 configured to secure the lid 120 when the lid 120 is nested within the top receiving area 118. Three of the detents 122 are depicted in FIG. 1, the remaining three detents 122 are not shown. A person of skill in the art will recognize that a variety of mechanisms and techniques can be used to secure the lid 120 to the top 110 of the rigid tray container 100.

Some embodiments of the rigid tray container 100 include at least one label affixation zone 124. In some embodiments, a label affixation zone 124 is a portion of the rigid tray container 100 configured for receiving a label such as a serialized label, or other identification labels, features, or devices which can be affixed to the rigid tray container 100 in a variety of positions. In some embodiments, a label can comprise one or several text strings, including, for examples, number and/or letter, computer readable coding, such as, for example, a bar code including, for example, an intelligent mail bar code, a 2-D bar code, a 3-D bar code, a QR code, or any other computer readable code, a transmission feature, such as a RFID tag, or any other feature capable of communicating information relating to the item to which the label is affixed. A person of skill in the art will recognize that the affixation zone 124 can comprise a variety of shapes and sizes, and can be placed in a variety of locations on the rigid tray container 100.

In some embodiments, the affixation zone 124 can comprise features configured to assist in affixing a label. In some embodiments, the affixation zone 124 can include a range of features to mechanically affix a label to the affixation zone, such as, for example, at least one snap, at least one detent, at least one sleeve, at least one securing protrusion, at least one tie, or any other securing feature. In some embodiments, the affixation zone 124 can comprise a particular portion of the rigid tray container 100, such as, for example, a portion of the rigid tray container 100 having a particular surface treatment, a portion of the rigid tray container 100 comprising a specific material, a portion of the rigid tray container 100 having a certain surface roughness or texture, or a portion of the rigid tray container 100 comprising any other features or configurations adapted for use with labeling.

As depicted in FIG. 1, in one non-exclusive embodiment, the affixation zone 124 comprises a depressed surface 126 that is depressed into the lid 120 of the rigid tray container 100. In some embodiments, the depressed surface can define a plane.

The depressed surface 126 can be surrounded by one or several walls 127. The walls 127 can be perpendicular relative to the portion of the lid 120 comprising the affixation zone 124 and perpendicular to the plane defined by the depressed surface 126. As further shown in FIG. 1, the affixation zone 124 includes a plurality of protrusions 128 configured to secure the label. In some embodiments, the protrusions 128 are located on or in the walls 127. In some embodiments, the protrusions 128 are positioned relative to the depressed surface 126 to allow placement of an item, such as, for example, a label, between the depressed surface 126 and the protrusions 128, which positioning can thereby secure the label. A person of skill in the art will recognize that the present disclosure is not limited to the number or size of protrusions or the size, shape or location of the depression as depicted in FIG. 1. Thus, in some embodiments, the size of the depression may be larger or smaller than that depicted in FIG. 1, the depressed surface 126 can be located on different parts of the rigid tray container 100, such as, for example, the bottom or one of the sides, the depression can comprise a different shape, and that a different type of securing feature, or a different number of protrusions 128 can be included with the affixation zone. In some embodiments, for example, one, two, three, four, five, six, or any other number of protrusions 128 can be used to secure the label.

In some embodiments, the label can be configured with mechanical properties adapted for use in connection with a mechanical securement feature. More specifically, in some embodiments, the label can be configured to be sufficiently rigid to allow snap securement of the label to the rigid tray container 100 in the affixation zone 124 by one or several protrusions 128. A person of skill in the art will recognize that the exact mechanical properties of the label will vary depending on the specific application.

Some embodiments of the rigid tray container 100 can further include features configured for facilitating transport and movement of the rigid tray container 100. The features can be configured to facilitate human or machine manipulation and transport of the rigid tray container 100. As depicted in FIG. 1, these features can include handles 130. Handles 130 can be made of a variety of materials and in a variety of sizes and shapes. Handles 130 can be further configured to facilitate manipulation of the rigid tray container 100 by a human or by a machine. In some embodiments, handles 130 can comprise a grip 131 located at the top 110 of one or more sides of the rigid tray container 100 that is configured to allow gripping access from both above and below the handle 130. In some embodiments, the grip 131 can be parallel or non-parallel to the portion of the rigid tray container 100 from which it extends. A person of skill in the art will recognize that the size and the shape of the handles 130 can match the application for with the rigid tray container 100 will be used. A person of skill in the art will further recognize that he handles 130 can be configured to support a designated load to facilitate manipulation of the rigid tray container 100.

In some embodiments, a rigid tray container can additionally include security features configured to allow determination of whether the contents of the rigid tray container 100 have been improperly accessed. In some embodiments, a security feature can include a security insert device. In some embodiments, the lid 120 of the rigid tray container 100 can be secured through the use of a security device. In some embodiments, the security device can be configured to hold the lid 120 on the rigid tray container 100. In some embodiments, for example, the security device can be inserted through a hole in the lid 120 of the rigid tray container 100 and through a hole on another portion of the rigid tray container 100 to secure the lid 120 to the rigid tray container 100. In some embodiments, the security feature may be a sealing strap that encircles the rigid tray container 100 and is removably connected to the surface of the lid 120 and one or more sides of the rigid tray container 100. A security device can be configured to only allow removal of the lid by destruction or removal of the security device.

In one embodiment, a security device comprises, for example, a plastic zip-tie. The plastic zip-tie is inserted through a hole in the lid 120 and a hole in the rigid tray container 100 and then secured. After being secured, the plastic zip-tie can be configured to only allow opening of the container by breaking the zip-tie.

Figure 2:
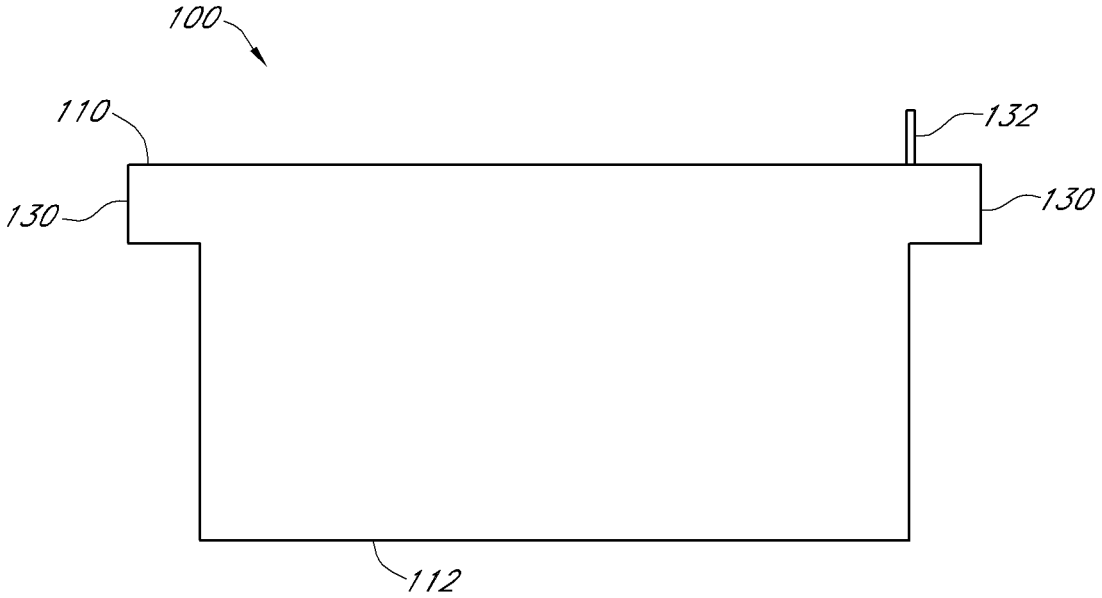
FIG. 2 depicts a side elevation view of one embodiment of a rigid tray container.

FIG. 2 depicts a side elevation view of the rigid tray container 100 depicted in FIG. 1. As shown in FIG. 1, the rigid tray container 100 includes a top 110 and a bottom 112. In some embodiments, the rigid tray container 100 can include at least one feature to facilitate stacking of rigid tray containers 100 on top of each other. This feature can be configured to stabilize the stacked rigid tray containers 100, or to index the position of each of the stacked rigid tray containers 100. In some embodiments the indexing feature can comprise a variety of shapes and sizes, made from a variety of materials, and located in a broad range of positions on the rigid tray container 100. FIG. 2 depicts one embodiment of the rigid tray container 100 comprising an indexing tab 132 located proximate to one of the handles 130 and extending from the plane defined by the top 110 of the rigid tray container 100. Specifically, the indexing tab 132 extends from the top 110 of the rigid tray container 100 and away from the plane defined by the bottom 112 of the rigid tray container 100.

Figure 3:
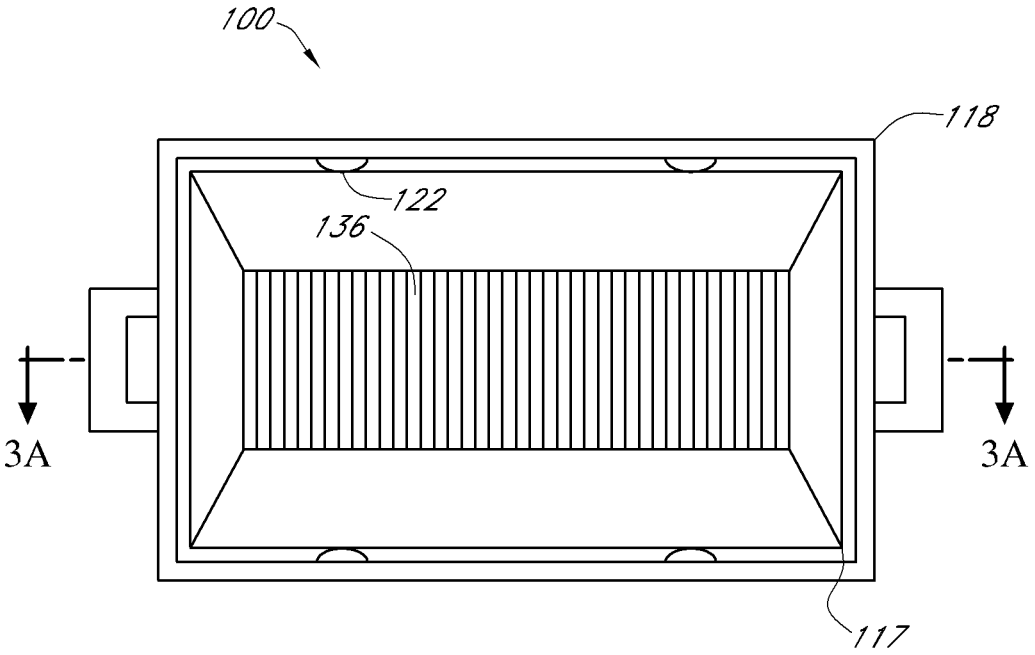
FIG. 3 depicts a top plan view of one embodiment of a rigid tray container.

FIG. 3 depicts a top plan view of one embodiment of the rigid tray container 100. The rigid tray container, as depicted in FIG. 3, can include, for example, a top receiving area 118 and a lip 117. In some embodiments, and as discussed above, the lip 117 is parallel with other portions of the top 110. In some embodiments, and as also discussed above, the lip 117 is non-parallel with other portions of the top 110. In some embodiments, for example, the lip 117 is located parallel to and below the top 110 of the rigid tray container 100. In some embodiments, the lip 117 is continuous around the rigid tray container 100, and in other embodiments, the lip 117 may be non-continuous around the rigid tray container 100. In some embodiments, the lip 117 of the rigid tray container 100 can be configured to, alone, or in connection with the lid 120 of a rigid tray container, allow the vertical stacking of a plurality of rigid tray containers 100 in a straight column.

As additionally seen in FIG. 3, the rigid tray container 100 can include detents 122 located in the top receiving area 118 of the rigid tray container 100. As depicted in FIG. 3, the detents 122 can extend from the top receiving area 118 so as to allow the securement of the lid 120 when the lid 120 is nested within the top receiving area 118. In some embodiments, the detents 122 can be configured to secure other features placed in contact with the top receiving area 118, including a second rigid tray container stacked on the top receiving area 118.

Figure 3A:
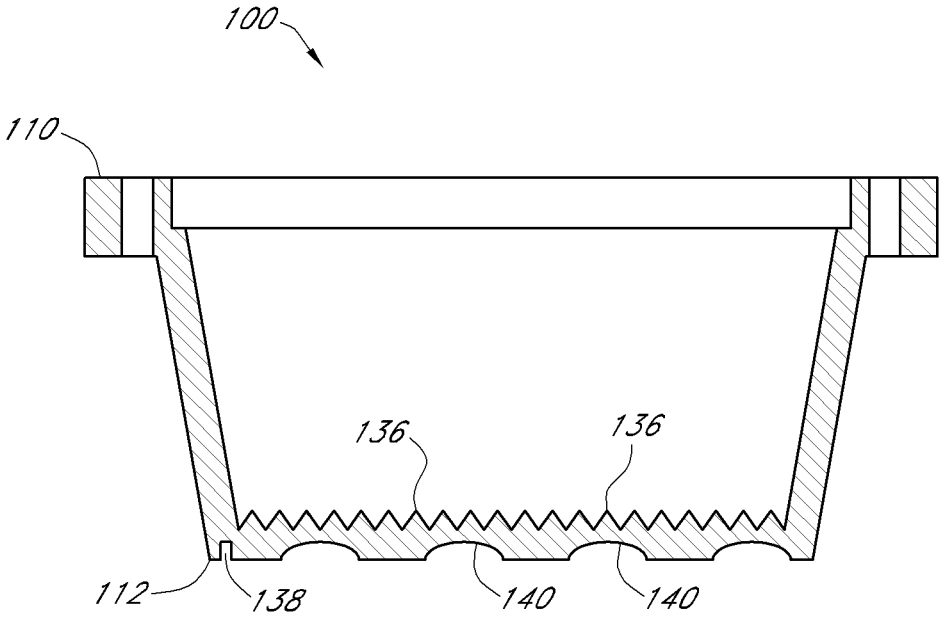
FIG. 3A depicts a cross-sectional view of one embodiment of a rigid tray container.

Some embodiments of the rigid tray container 100 can, for example, include features to facilitate loading and unloading of objects into the rigid tray container 100. In some embodiments, these features can be configured to prevent movement of objects loaded into the rigid tray container 100. In one embodiment of the rigid tray container 100, the rigid tray container 100 can include one or several protrusions 136 in the bottom of the rigid tray container. In some embodiments, the protrusions 136 can be an array of point protrusions. In some embodiments, the protrusions 136 can be a series of ridge-like linear protrusions. FIG. 3 depicts a rigid tray container 100 having a plurality of parallel, linear protrusions 136 in the bottom of the rigid tray container 100. FIG. 3A, which is a cross-sectional view of the embodiment shown in FIG. 3, depicts one embodiment of a rigid tray container 100 having a top 110 and a bottom 112. As seen in FIG. 3A, the protrusions 136 extend from the inner surface of the bottom 112 of the rigid tray container 100 towards the top 110 of the rigid tray container 100.

In some embodiments, the protrusions 136 can be sized and shaped to prevent movement of objects loaded into the rigid tray container 100. In one embodiment, the protrusion 136 can be sized and shaped to prevent movement, such as, for example, sliding of articles, letters, mail packages, or any other items that have been loaded into a rigid tray container 100.

Figure 4:
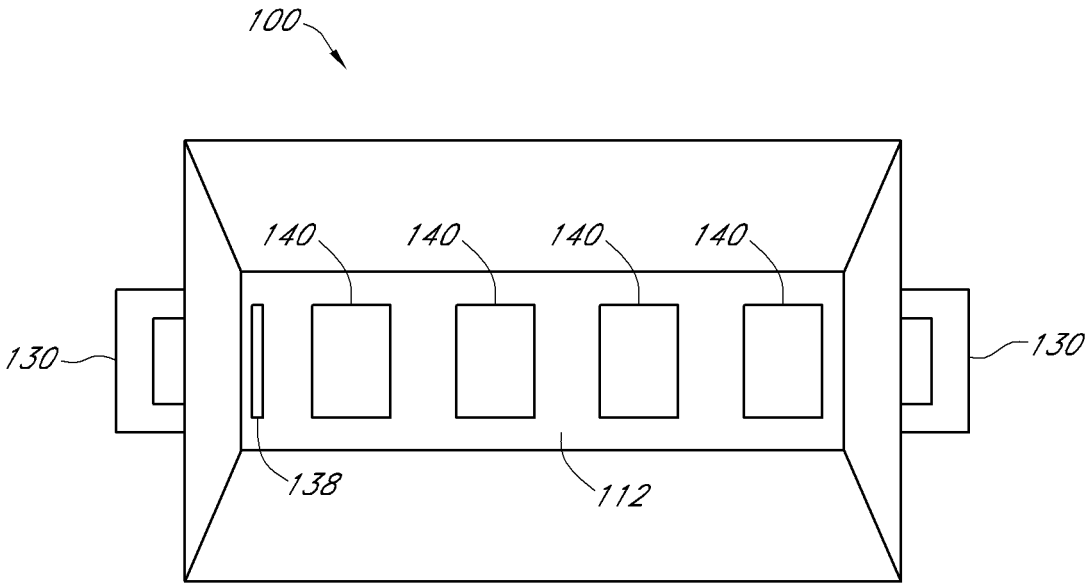
FIG. 4 depicts a bottom plan view of one embodiment of a rigid tray container.

FIG. 4 depicts a bottom plan view of one embodiment of the rigid tray container 100. The rigid tray container depicted in FIG. 4 has a bottom 112 and handles 130. In some embodiments, the rigid tray container 100 can include an indexing feature configured to mate with the indexing tab 132 when a plurality of rigid tray containers 100 is stacked. In some embodiments, and as depicted in FIG. 4, the indexing feature can comprise an indexing aperture 138 sized and shaped to receive the indexing tab 132 when a plurality of rigid tray containers 100 are stacked. In some embodiments, the indexing aperture 138 can be located proximate to the same side of the rigid tray container 100 as to which the indexing tab 132 is proximally located. In some embodiments, the indexing aperture 138 can be located proximate to a different side of the rigid tray container 100 than the side in which the indexing tab 132 is proximally located. In one embodiment, the indexing aperture 138 can be located proximate to the side of the rigid tray container that is opposite to the side of the rigid tray container to which the indexing tab 132 is proximally located. In some embodiments, the location of the indexing tab 132 and the indexing aperture 138 relative to each other on the rigid tray container 100 can result in different stacking alignments of rigid tray containers 100. Such stacking alignments can advantageously increase the stability of a stack of containers by assisting in the maintenance of a geometrically centered center of gravity. In some embodiments one end of the rigid tray containers 100 may have a shape or contour such that each rigid tray container 100 can be stacked only in a particular configuration. For example, one end of the rigid tray container 100 configured to receive only a correspondingly shaped end of another rigid tray container 100. In some embodiments, one end may be square and the other end of the rigid tray container 100 may be rounded such that the square end will not easily stack with the square end.

In some embodiments, and as depicted in FIG. 4, the bottom 112 of the rigid tray container 100 can also have one or more indentations 140. The indentations 140 can be randomly or non-randomly arranged. In some embodiments, the indentations 140 can be arranged in a linear pattern as depicted in FIG. 4. In some embodiments, the indentations 140 can be arranged in a non-linear pattern. The In some embodiments, the indentations 140 can be configured to increase the structural strength of the rigid tray container 100 by breaking up the plane created by the bottom 112 of the rigid tray container 100. In some embodiments, the indentations 140 are round, rectangular, triangular, or have a perimeter of any other desired shape. In some embodiments, the indentations 140 define a rounded volume, a triangular volume, a rectangular volume, or a volume having any other desired shape. In some embodiments, the indentations 140 can be configured to increase the stability of the tray during handling or transport.

The different features of the rigid tray container 100 discussed above can be combined in numerous ways to increase the strength and stability of the rigid tray container 100. In some embodiments, the rigid tray container 100 and its components, such as, for example, the lid 120 can be weight optimized to minimize the weight of the system while maintaining required stacking strength. This optimization can be achieved through the use of, for example, the indentations 140 in a bottom 112 of the rigid tray container 100, or through the use of other features, such as flanges 142.

Figure 5A:
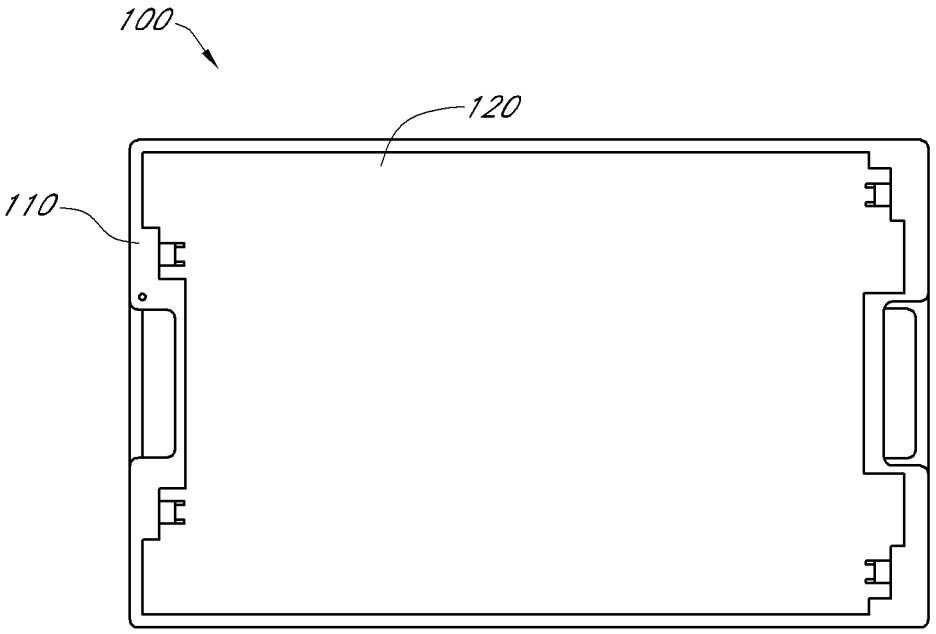
FIG. 5A-5D depict views of one embodiment of a rigid tray container.
Figure 5B:
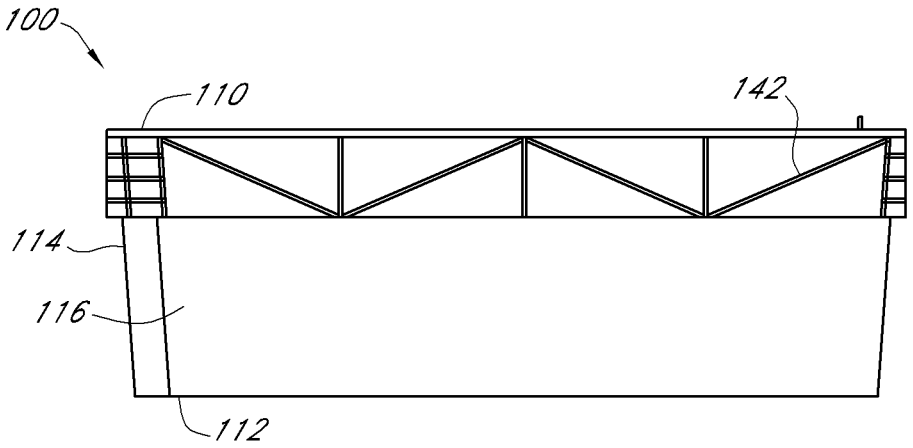
Figure 5C:
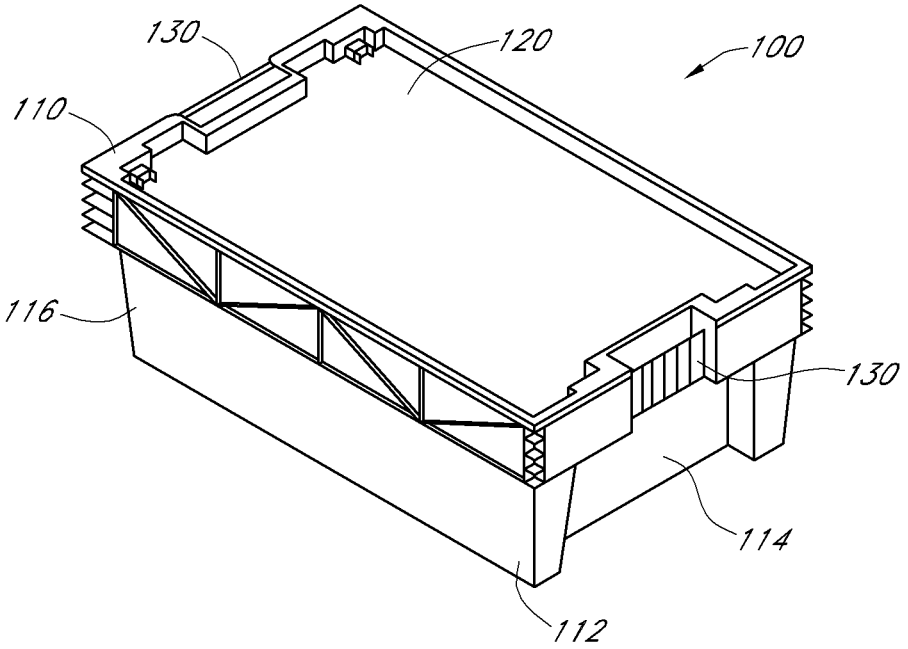
Figure 5D:
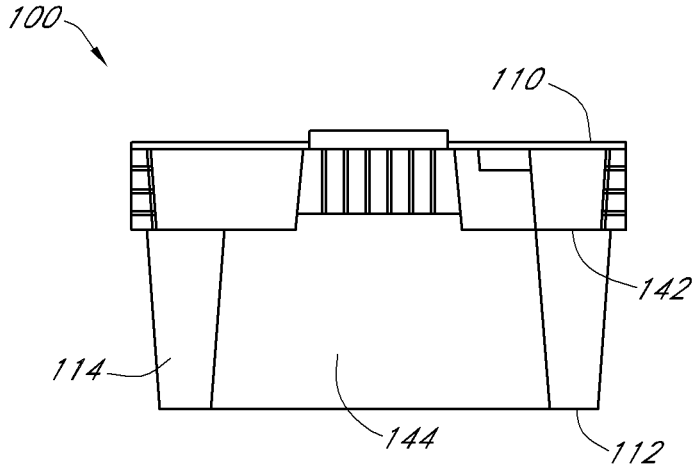

FIG. 5A depicts a top plan view of one embodiment of the rigid tray container 100 having a top 110 and a lid 120. FIG. 5B depicts a side elevation view of one embodiment of the rigid tray container 100 having a top 110, a bottom 112, a first side 114, a second side 116, and a plurality of flanges 142. FIG. 5C depicts a perspective view of one embodiment of the rigid tray container 100 having a top 110, a bottom 112, a first side 114, a second side 116, a lid 120, and handles 130. FIG. 5D depicts an end elevation view of one embodiment of the rigid tray container 100 having a top 110, a bottom 112, a first side 114, a plurality of flanges 142, and depression 144. As depicted in FIGS. 5A-5D, a rigid tray container 100 can include structural features to allow weight optimization in light of the desired strength of the container 100. Specifically, as depicted in FIG. 5, the rigid tray container 100 can include a flange 142. In some embodiments, the rigid tray container 100 can comprise a pattern of flanges 142 positioned on or around a portion of the rigid tray containers. Advantageously, these flanges 142 can increase the strength of the rigid tray container 100. These flanges 142 can further advantageously provide strength without increasing the thickness of all portions of the bottom and sides. As also seen in FIG. 5, the flanges 142 can be arranged in a pattern to increase the strength of the rigid tray container 100. The flanges 142 can be, for example, arranged in any desired manner, including arrangement in a lattice or any other pattern. In some embodiments, the flanges 142 can be formed of the same material as the rigid tray container 100, and in some embodiments, the flanges can be formed of a different material than the rigid tray container 100. In some embodiments, the flanges 142 can extend perpendicularly outward from the sides of the rigid tray container 100, and in some embodiments, the flanges 142 may be integrally and non-visibly formed within the rigid tray container 100.

As additionally depicted in FIGS. 5A-D, some embodiments of the rigid tray container 100 can further include a structural indentation 144 in one or more sides of the rigid tray container 100. Specifically, FIGS. 5A-D depict a depression in the first side 114 of the rigid tray container 100. A similar structural indentation 144 can be located opposite the first side 114 in the third side, or can be located in all or only some of the sides of the rigid tray container 100. Advantageously, the addition of a structural indentation 144 to one or several sides of the rigid tray container 100 can increase the strength and/or stiffness of the rigid tray container 100 by increasing the second moment of area of the side in which the structural indentation 144 is located. In some embodiments the structural indentations can be of alternating construction on the end to allow stacking when oriented in one direction and nesting when rotated 180 degrees.

Rigid Tray Container System

The rigid tray container 100 can be used as part of an integrated transport system to allow batch processing of items. The items can comprise a variety of items, including, for example, one or several mail pieces. Automation of such a system requires additional machines configured for use with a rigid tray container, and additional containers. FIGS. 6 through 11 relate to such components of a rigid tray container system.

Figure 6A:
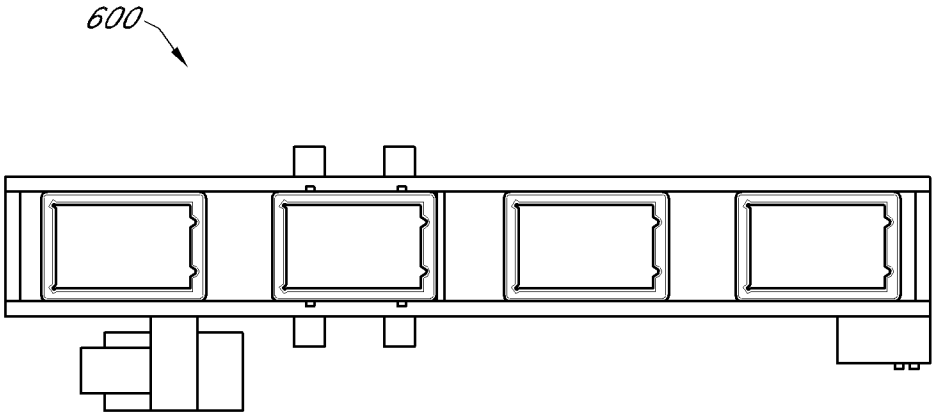
FIG. 6A-6C depict views of one embodiment of a rigid tray container lidding and unlidding machine.
Figure 6C:
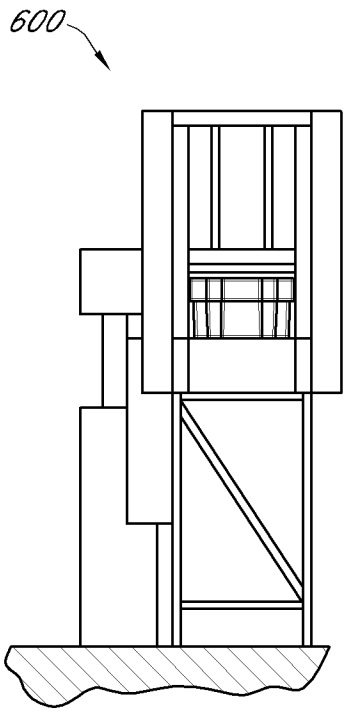
Figure 6B:
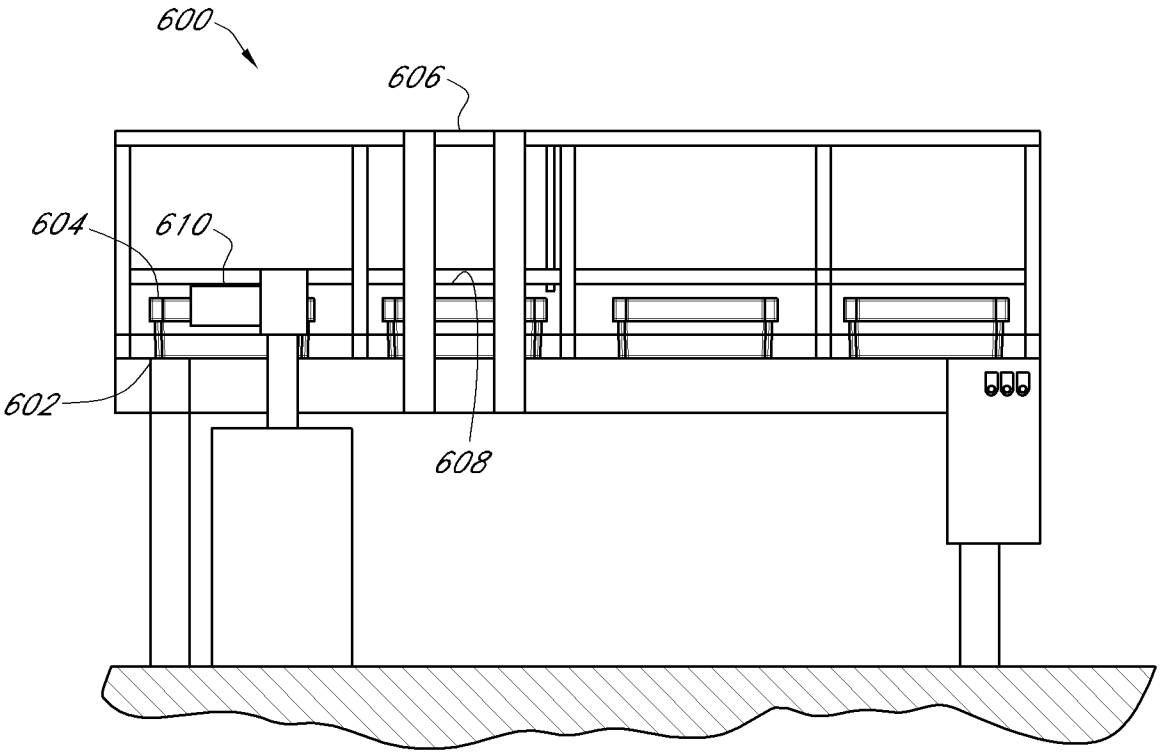

FIG. 6A depicts a top plan view, of one embodiment of the rigid tray lidding and unlidding machine 600, FIG. 6B depicts a side elevation view of one embodiment of the rigid tray lidding and unlidding machine 600, and FIG. 5C depicts an end view of one embodiment of the rigid tray lidding an unlidding machine. The rigid tray lidding and unlidding machine 600 can comprise a variety of features and components, and can thus have be built to a wide range of dimensions. The rigid tray lidding and unlidding machine 600 can be configured to operate at a range of speeds. In some embodiments, the rigid tray lidding and unlidding machine 600 can be configured to process up to 10,000, up to 50,000, up to 67,200, up to 100,000, up to 376,200, up to 500,000, up to 1,000,000, or up to any other desired number of letters or flats per hour. In some embodiments, the rigid tray lidding and unlidding machine 600 can be configured to process up to 10, up to 20, up to 50, up to 60, up to 100, up to 1,000, up to 1,200, up to 2,500, up to 5,000, or up to any other desired number of rigid tray containers 100 per hour.

In some embodiments, the rigid tray lidding and unlidding machine 600 can be configured tor placing the lid 120 on the rigid tray container 100 or for removing the lid 120 from the rigid tray container 100. The rigid tray lidding and unlidding machine 600, as depicted in FIG. 6B, can comprise a transport feature 602 configured to transport one or more rigid tray containers 604. These features can include, for example, a moving belt, powered rollers, powered wheels, or any other features capable of moving one or several rigid tray containers. The transport feature 602 of the rigid tray lidding and unlidding machine 600 can be located at any desired vertical position, including on the ground, or elevated some distance above the ground. In some embodiments, the transport feature 602 of the rigid tray lidding and unlidding machine 600 can be elevated above the ground to approximately waist height to facilitate access to the machine. A rigid tray lidding and unlidding machine 600 can have different stations to perform functions of lidding and unlidding a rigid tray container 604. These stations can include, for example, a lid stack configured to store lids removed from one or several rigid tray containers 604 or to be placed on one or several rigid tray containers 604, a lidding station configured to lid one or several rigid tray containers 604 or to unlid one or several rigid tray containers 604, a scanning station to scan the encoded material on one or several rigid tray containers 604, a securement removal station to remove any straps or securement features from the rigid tray container 604, and a securement feature disposal station that disposes securement features that were on the rigid tray container 604.

FIG. 6B depicts a lid stack 606 positioned vertically above a lidding station 608. In some embodiments, the lid stack 606 can be accessible to allow the addition of lids to or the removal of lids from the lid stack 606 based on the current needs of the lidding and unlidding machine 600. In some embodiments, the lidding and unlidding machine 600 can be configured to automatically provide lids to or remove lids from the lid stack 606. In some embodiments, and as depicted in FIG. 6B, the lidding station 608 can be disposed in vertical alignment with the lid stack 606. Advantageously, such positioning facilitates placement of a lid on a rigid tray container 604 or placing a lid in the lid stack 606.

FIG. 6B further depicts an embodiment of a rigid tray lidding unlidding machine 600 with a securement removal station 610. This station is configured to remove one or more securement features, such as, for example, a strap, a lock, wire, adhesive, or string from a rigid tray container. In some embodiments, the securement removal station 610 can be configured to cut a securement feature to allow its removal. In some embodiments, the securement removal station 610 can include a separate or an integrated securement features disposal station that disposes the removed securement features.

Figure 7:
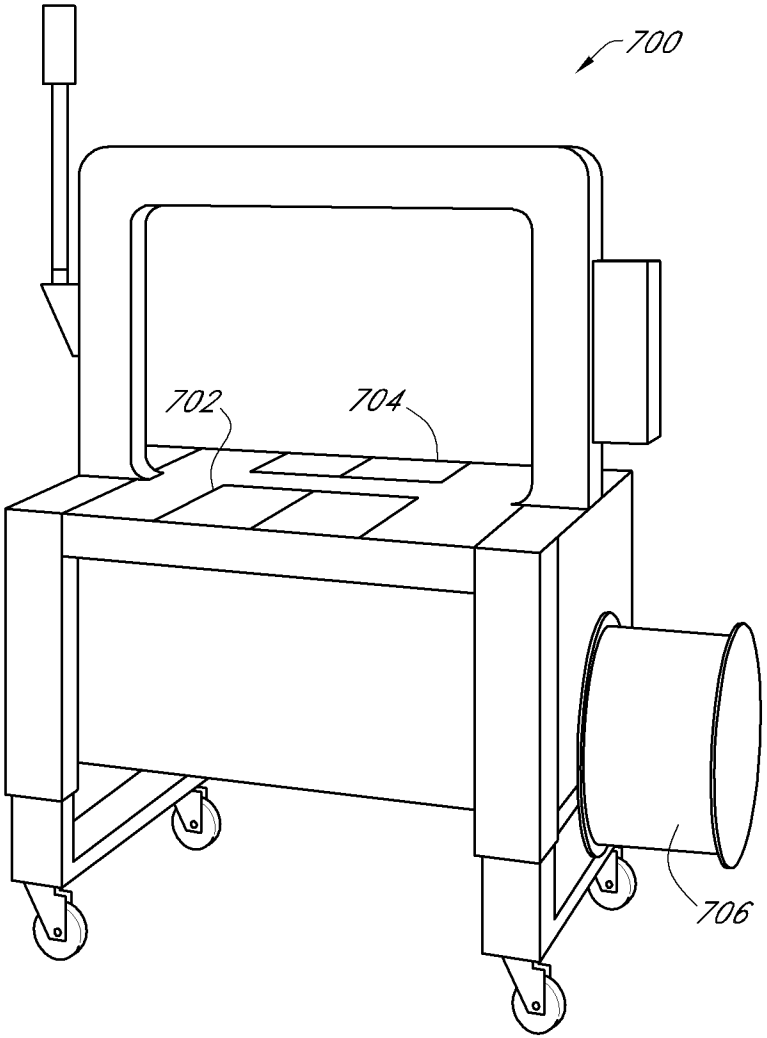
FIG. 7 depicts a perspective view of one embodiment of a securement device.

The rigid tray container system can also include a device configured to secure the lid of a rigid tray container. FIG. 7 depicts one embodiment of a securement device 700 configured to secure a lid 120 to a rigid tray container 100. The securement device 700 can comprise a variety of features and components, and can thus be built to a wide range of dimensions. The securement device 700 can be configured to operate at a range of speeds. In some embodiments, the securement device 700 can be configured to process up to 10,000, up to 50,000, up to 100,000, up to 100,800, up to 500,000, up to 564,300, up to 1,000,000, or up to any other desired number of letters or flats per hour. In some embodiments, the securement device 700 can be configured to process up to 10, up to 20, up to 50, up to 60, up to 100, up to 1,000, up to 1,800, up to 2,500, up to 5,000, or up to any other desired number of rigid tray containers 100 per hour.

The securement device 700 depicted in FIG. 7 has transport features to transport a rigid tray container 100 to and from the lid securement features of the securement device 700. Advantageously, these features enable integrated use of the lid securement device in an automated handling system, as the transport features automatically transport the rigid tray container 100 to the lid securement features. These transport features can include, for example, a moving belt, powered rollers, powered wheels, or any other features capable of moving one or several rigid tray containers 100. Specifically, the securement device 700 has a first conveyor belt 702 and a second conveyor belt 704 configured to move the rigid tray container 100. The securement device 700 additionally includes features to scan an identifier, such as, for example, a label on the rigid tray container 100, as well as controls and features to secure the lid 120 to the rigid tray container 100. The securement device 700 depicted in FIG. 7 secures the lid 120 to the rigid tray container 100 with strapping taken from a spool 706. The strapping can be wrapped around a portion of the rigid tray container 100 and secured to itself so as to secure the lid 120 to the rigid tray container 100. In one embodiment, for example, a piece of strapping is wrapped around the rigid tray container 100 and secured to itself by heat fusing, an adhesive, mechanical securement feature, or any other desired securement method. Although FIG. 7 depicts one embodiment of the securement device 700, the securement device 700 can include a variety of different features, different securement mechanisms, and use different forms of securement such strapping, wire, twine, string, adhesive, band, or any other desired form of securement.

Figure 8B:
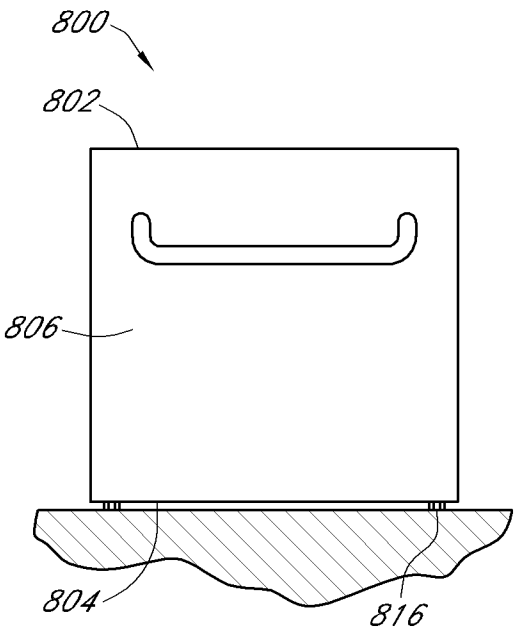
FIG. 8A-8D depict views of one embodiment of a mass container.
Figure 8A:
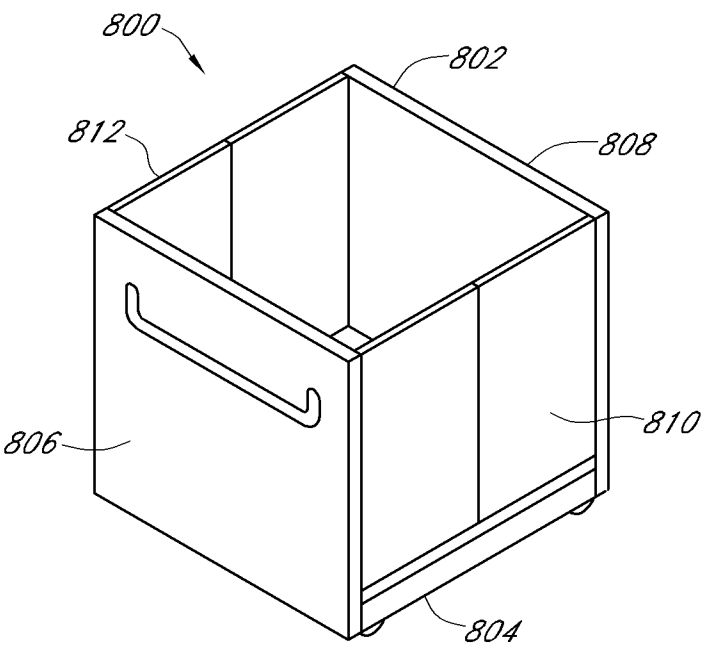
Figure 8D:
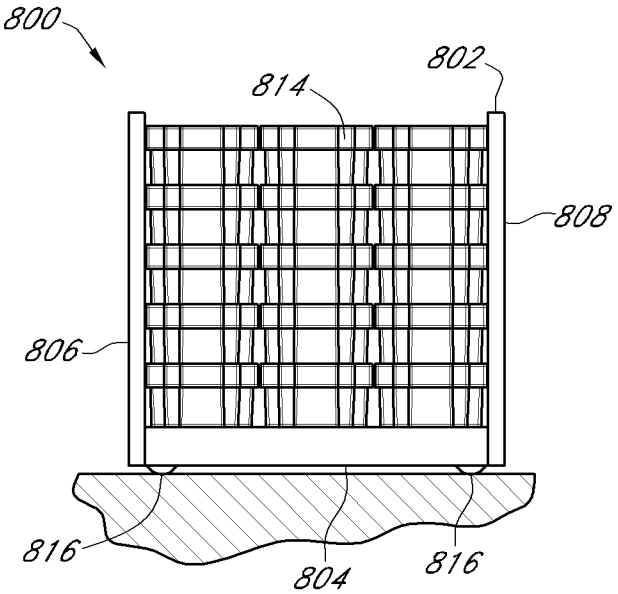
Figure 8C:
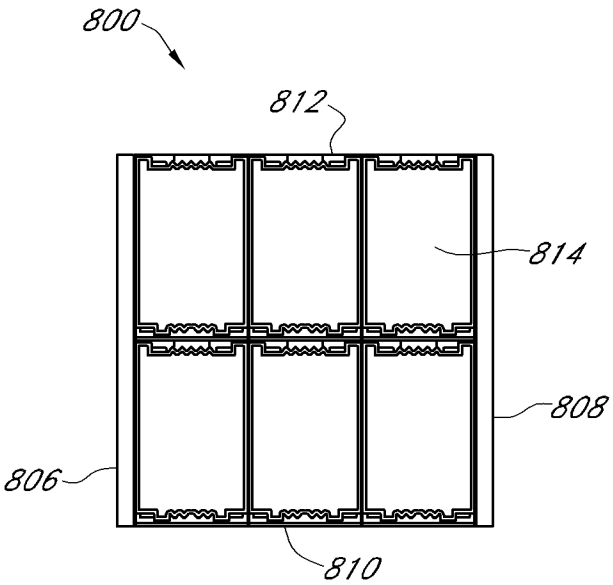

Some embodiments of the rigid tray system can include one or several mass containers sized and dimensioned to hold a plurality of rigid tray containers 100. In some embodiments, these mass containers can facilitate batch processing of rigid tray containers 100 and items held by the rigid tray containers 100 by allowing tracking of a single large container as opposed to tracking of several smaller rigid tray containers 100. FIG. 8A depicts a perspective view of one embodiment of a mass container 800, FIG. 8B depicts a front elevation view of one embodiment of a mass container 800, FIG. 8C depicts a top plan view of one embodiment of a mass container 800, and FIG. 8D depicts a side view of one embodiment of a mass container 800. The mass container 800 can comprise a variety of features and components, and can thus be built to a wide range of dimensions. The mass container 800 can be configured to hold a variety of items. In some embodiments, the mass container 800 can hold 1 tray, 5 trays, 10 trays, 25 tray, 30 trays, 50 trays, 100 trays, or any other desired number of trays. In some embodiments, the mass container 800 can be configured to hold 100, 1,000, 1,680, 2,500, 5,000, 9,390, 10,000, 25,000, 50,000, or any other number of letters and/or flats. In some embodiments the mass container 800 can be configured with a volume of 1 cubic foot, 5 cubic feet, 10 cubic feet, 25 cubic feet, 34.4 cubic feet, 50 cubic feet, 100 feet, or any other desired volume.

As depicted in FIG. 8A, the mass container 800 can have a top 802, a bottom 804, a first side 806, a second side 808, a third side 810, and a fourth side 812. In some embodiments, the mass container 800 can include locations configured for attachment of identification for the mass container 800. Attached identification can include any form of identification. In some embodiments, the identification can be, for example, human or machine readable identification, such as, for example, writing or encoding, electronic identification, such as, for example, an identification chip or an RFID tag, or any other desired form of identification. In some embodiments, the identification can be, for example, a label. In some embodiments, the mass container 800 can include a snap-in label holder to facilitate identification attachment. The snap in label holder can include similar features to those disclosed above in relation to the rigid tray container 100, and can be located on one of the sides 806, 808, 810, 812 of the mass container 800.

The top 802, bottom 804, and sides 806, 808, 810, 812 can define a volume in which one or several rigid tray containers 814 can be loaded. As depicted in FIG. 8A, some embodiments of a mass container 800 can have one or more sides which can, in some embodiments, be configured for removability. Specifically, as depicted in FIG. 8A, the third side 810 and the fourth side 812 are each of two-piece construction and are removable from the mass container 800. Advantageously, the removability of sides 810, 812 can facilitate loading and unloading of the mass container as well as providing other benefits. In some embodiments, sides 810, 812 can be stored within in the mass container 800, such as, for example, in the ends of the mass container 800. Removal of sides 810, 812 can enable configuring of the mass container into a hamper/pallet box. In some embodiments the sides 806 and 808 can be folded inward and down to the bottom internal surface of the mass container. With the sides 806 and 808 folded down, the mass containers can be closely or densely stacked or stored when empty.

In some embodiments, the mass container 800 can be configured to allow stacking of mass containers 800. In some embodiments, the top 802 and bottom 804 of the mass container 800 can include features to facilitate stacking, such as, for example, an indexing feature, a stabilizing feature, a locking features, or any other feature. In some embodiments, the mass container 800 can include features for connecting multiple mass containers 800 together. These can include, for example, aligned connection points on a side or on a corner. In some embodiments, the mass container 800 can include interlocking type corners to allow the connection with another mass container 800 or other object having similar interlocking type corners.

In some embodiments, the bottom 802 of the mass container 800 can be sufficiently large to fit a single rigid tray container 814, two rigid tray containers 814, three rigid tray containers 814, four rigid tray containers 814, six rigid tray containers 814, eight rigid tray containers 814, or any other desired number of rigid tray containers 814. In one embodiment, the mass container 800 can comprise a wide configuration. In one embodiment, the mass container 800 can comprise a narrow configuration. As depicted in FIG. 8D, the mass container 800 is sized and configured to hold five layers of rigid tray containers 814. As depicted in FIG. 8C, the mass container 800 can be sized and configured so that each layer of rigid tray containers 814 can hold up to six rigid tray containers 814.

The mass container 800 can be configured to be towable. In some embodiments, a mass container can include features configured to allow towing of the mass container 800. These features can include loops, hooks, tow-holes, tow-points, or any other feature configured to allow towing. In some embodiments, these tow features can be located on one or more of the sides 806, 808, 810, 812 of the mass container 800, and preferably on one or both the first side 806 and the second side 808. The tow features can be located at any point on the sides, but can be advantageously located, for example, proximate to the bottom 804 of the mass container 800. In some embodiments a mass container 800 can comprise a first set of towing features on one side of the mass container 800 and a second set of towing features on another side of the mass container 800. In some embodiments, the towing features on one of the sides of the mass container can be male towing features, and the towing features on the other side of the mass container can be female towing features.

In some embodiments, multiple mass containers 800 can be connected to allow train-towing of multiple mass containers 800. Some embodiments of the mass container 800 can further include, for example wheels, and/or a brake to ease moving of the mass container 800. As depicted in FIGS. 8A, 8B, and 8D, some embodiments of a mass container can include, for example, four wheels 816. Wheels 816 can be located proximal to one of each of the corners of the bottom 804 of the mass container. In some embodiments, the wheels 816 can be fixed to only allow rolling in two directions. In some embodiments, the wheels 816 can be mounted on a swivel to allow rolling in any direction. In some embodiments, some of the wheels 816 can be mounted on a swivel, and some of the wheels 816 can be fixed. In some additional embodiments, the mass container 800 can be configured with rollers, slide plates, or any other feature to facilitate moving the mass container 800.

Figure 9A:
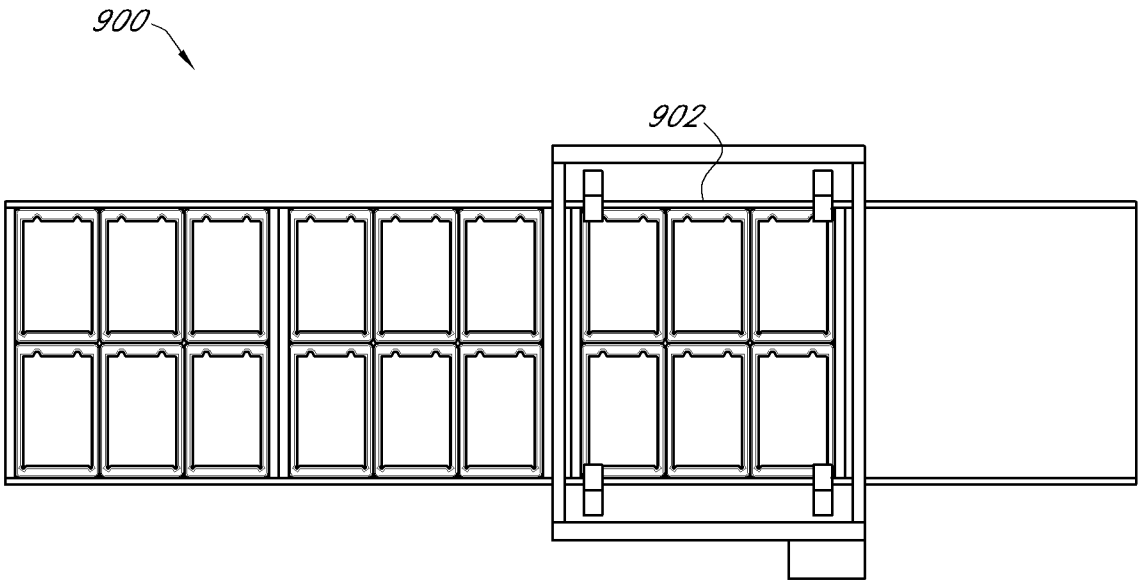
FIG. 9A-9C depict views of one embodiment of a mass container stacking machine.
Figure 9C:
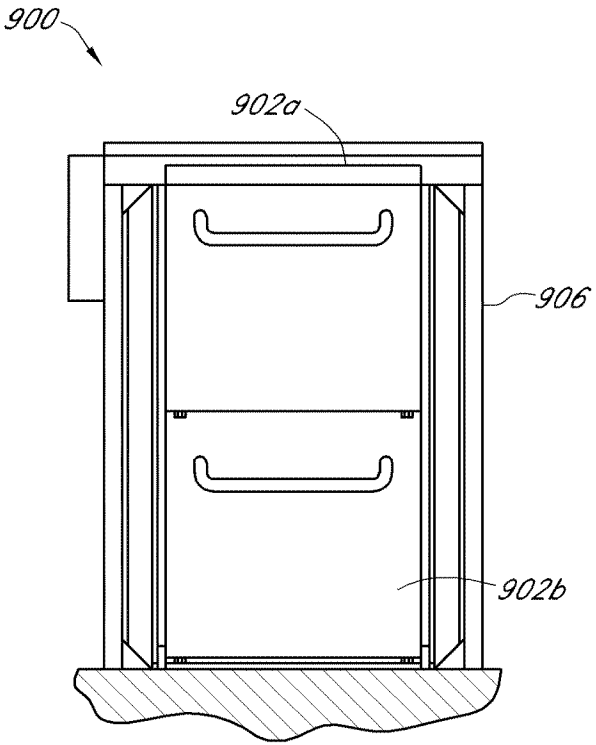
Figure 9B:
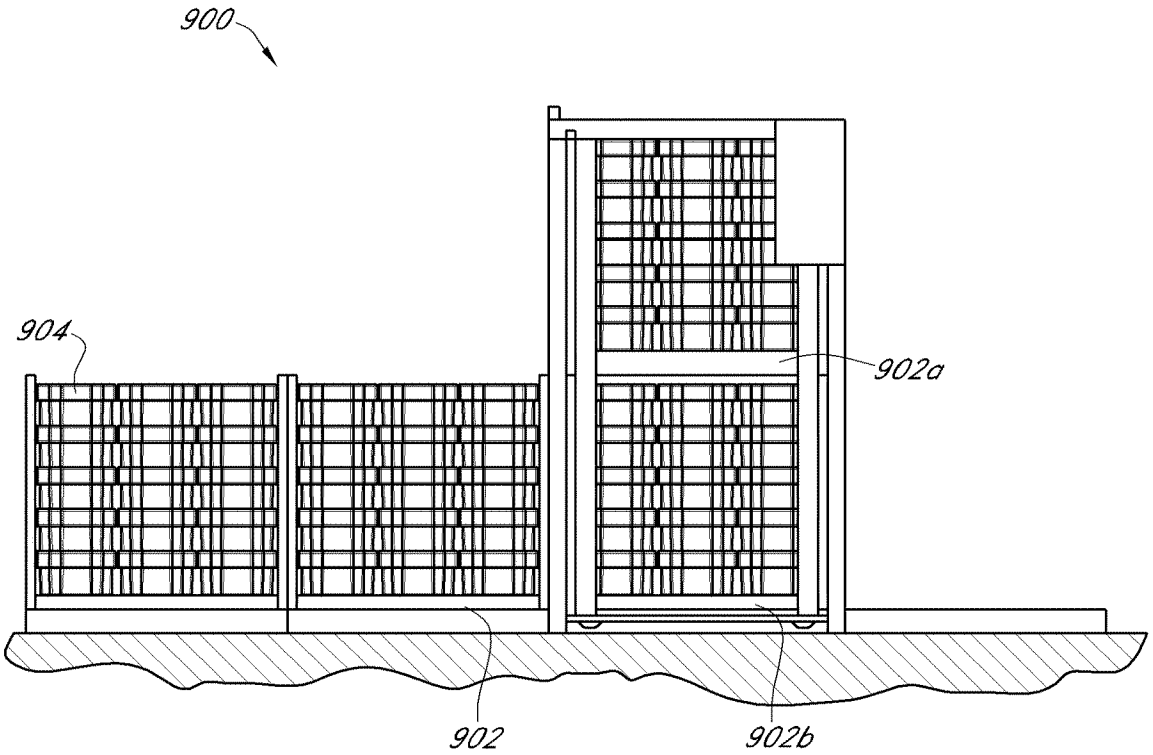

Some embodiments of a rigid tray system can include apparatuses configured to stack and/or unstack mass containers 800. FIG. 9A depicts a top plan view of one embodiment of a mass container stacker 900, FIG. 9B depicts a front elevation view of one embodiment of the mass container stacker 900, and FIG. 9C depicts a side elevation view of one embodiment of the mass container stacker 900. The mass container stacker 900 can comprise a variety of features and components, and can thus be built to a wide range of dimensions. The mass container stacker 900 can be configured to operate at a range of speeds. In some embodiments, the mass container stacker 900 can be configured to process up to 10,000, up to 50,000, up to 100,000, up to 100,800, up to 500,000, up to 564,300, up to 1,000,000, or up to any other desired number of letters or flats per hour. In some embodiments, the mass container stacker 900 can be configured to process up to 10, up to 20, up to 50, up to 60, up to 100, up to 1,000, up to 1,800, up to 5,000, or up to any other desired number of rigid tray containers 100 or mass containers 800 per hour.

As depicted in FIG. 9B, the mass container stacker 900 can be configured for stacking and/or unstacking mass containers 902. In some embodiments, the mass containers 902 can be empty or filled. In some embodiments, and as depicted in FIG. 9A, the mass containers 902 are filled with a plurality of rigid tray containers 904.

The mass container stacker 900 comprises a stacker 906 configured to stack the mass containers 902 by lifting a first mass container 902*a* and placing it on top of a second mass container 902*b*. In some embodiments, the mass container stacker 906 comprises features configured for engaging the first mass container 902*a* to facilitate lifting of the first mass container 902*a*. In some embodiments, the mass container stacker 906 further comprises features configured to position the second mass container 902*b* under the first mass container 902*a* after the first mass container 902*a* is lifted. After positioning the second mass container 902*b* under the first mass container 902*a*, the mass container stacker 906 can stack the first mass container 902*a* on the second mass container 902*b*.

Figure 10A:
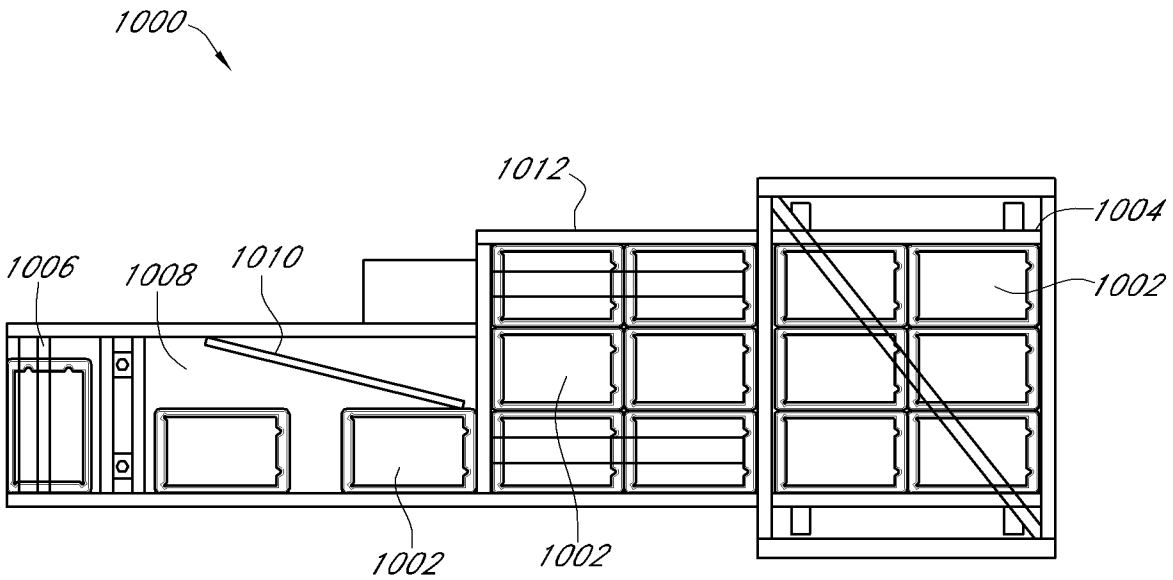
FIG. 10A-10C depict views of one embodiment of a mass container loading-unloading machine.
Figure 10C:
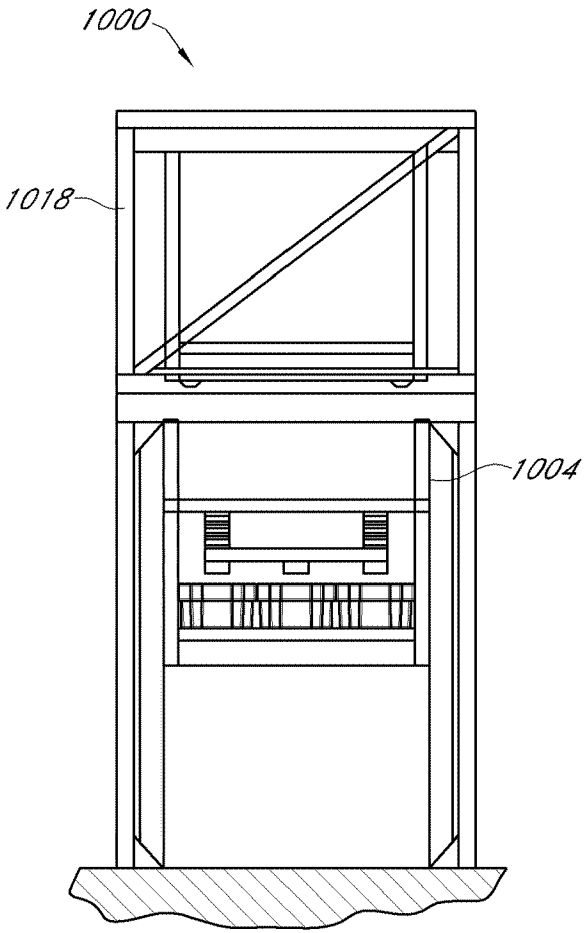
Figure 10B:
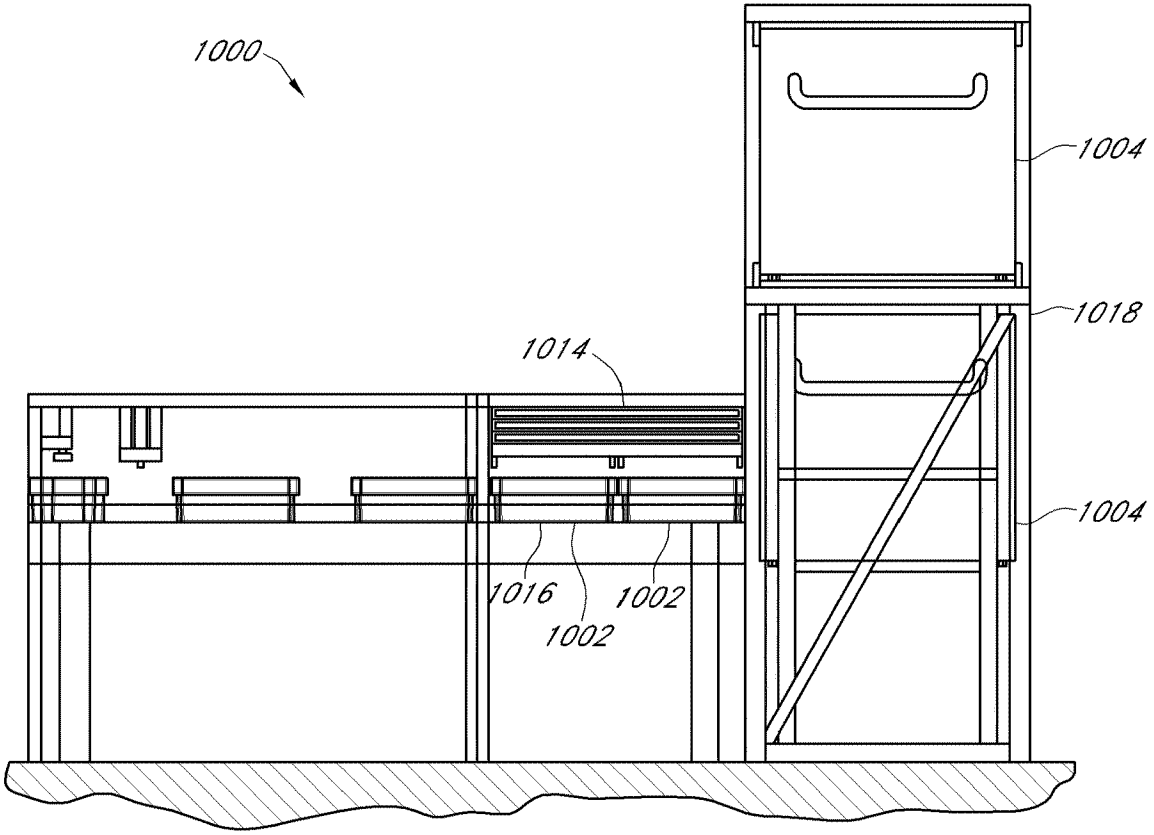

Some embodiments of the rigid tray system can include an apparatus configured for loading or unloading one or several rigid tray containers into a mass container, such as, for example, a wide or narrow mass container. FIG. 10A depicts a top plan view of one embodiment of a mass container loading-unloading machine 1000, FIG. 10B depicts a front elevation view of one embodiment of the mass container loading-unloading machine 1000, and FIG. 10C depicts a side elevation view of one embodiment of the mass container loading-unloading machine 1000. The mass container loading-unloading machine 1000, as depicted in FIG. 10B, can load or unload one or several rigid tray containers 1002 into the mass container 1004. The mass container loading-unloading machine 1000 can be configured to load, for example 100 flats per hour, 1,000 flats per hour, 10,000 flats per hour, 33,600 flats per hour, 100,000 flats per hour, or any other number of flats per hour. In some embodiments, the mass container loading-unloading machine 1000 can be configured to load 1,000 letters per hour, 10,000 letters per hour, 100,000 letters per hour, 188,100 letters per hour, 1,000,000 letters per hour, or any other amount of letters per hour. In some embodiments, the mass container loading-unloading machine 1000 can be configured to load 10 rigid tray containers 1002 per hour, 100 rigid tray containers 1002 per hour, 500 rigid tray containers 1002 per hour, 600 rigid tray containers 1002 per hour, 1,000 rigid tray containers 1002 per hour, or any other desired number of rigid tray containers 1002 per hour. In some embodiments, the mass container loading-unloading machine 1000 can be configured to load 1 mass container 1004 per hour, 5 mass containers 1004 per hour, 10 mass containers 1004 per hour, 20 mass containers 1004 per hour, 50 mass containers 1004 per hour, or any other desired number of mass containers 1004 per hour.

The mass container loading-unloading machine 1000 can comprise a variety of sizes, configurations, and dimensions. Further, the mass container loading-unloading machine 1000 can load or unload both full and empty rigid tray containers 1002. The mass container loading-unloading machine 1000 can load or unload rigid tray containers 1002 with lids 120, or without lids 120. In some embodiments, a mass container loading-unloading machine 1000 can stack several empty rigid tray containers 1002 before loading them into mass container loading-unloading machine 1000. In some embodiments, a mass container loading-unloading machine 1000 can be configured to individually load each rigid tray container 1002. In some embodiments, a mass container loading-unloading machine 1000 can be configured to simultaneously load a plurality of rigid tray containers 1002. FIG. 10A depicts one embodiment of a mass container loading-unloading machine 1000 configured to simultaneously load a plurality of rigid tray containers 1002.

A mass container loading-unloading machine 1000 can include features configured to gather or receive identification information from the loaded or unloaded rigid tray containers 1002. This identification is discussed at greater length above in reference to the rigid tray containers 100. These features can include, for example, a reader, a scanner, a transmitter, a receiver, or any other feature capable of gather or receiving identification information from the rigid tray containers 1002. In some embodiments, a mass container loading-unloading machine 1000 can further include features configured to gather or receive identification information from a mass container 1004 used in connection with the mass container loading-unloading machine 1000. This identification is discussed at greater length above in reference to the mass containers 800. These features can include, for example, a reader, a scanner, a transmitter, a receiver, or any other feature capable of gather or receiving identification information from the mass container loading-unloading machine 1000. In some embodiments, the mass container loading-unloading machine 1000 can be configured for adding one or several identification features to a mass container 1004. In some embodiments, for example, the mass container loading-unloading machine 1000 can be configured to add a label to a label affixation feature of a mass container 1004 as discussed at greater length above. In some embodiments, for example, the mass container loading-unloading machine 1000 can comprise features configured to affix computer readable code to a portion of the mass container 1004. In some embodiments, the mass container loading-unloading machine 1000 can comprise features configured to affix an electronic identification device to the mass container 1004.

The mass container loading-unloading machine 1000 comprises a tray label reader 1006 capable of determining the orientation of the tray. For example, the rigid tray container 1002 tray may have a label on one end. If the tray label reader 1006 is able to read a label on the rigid tray container, then the tray label reader 1006 can identify the orientation of the tray. If the tray label reader is not able to read the label, the tray label reader 1006 can likewise know the orientation of the rigid tray container. In some embodiments, the tray label reader 1006 may be an optical scanner or sensor configured to determine the orientation of the rigid tray container 1002 when the rigid tray container 1002 is inserted into the mass container loading-unloading machine 1000. The mass container loading-unloading machine 1000 may also comprise a first transport area, a rigid tray container rotator 1008, a rigid tray container aligner 1010, a staging area 1012, a tray layer shuttle device 1014, a transport area 1016, and a mass container manipulator 1018. As depicted in FIG. 10A, a rigid tray container 1002 is received and the tray label reader 1006 scans or looks to identify the orientation of the rigid tray container 1002. A tray transport feature (not shown) transports one or several rigid tray containers 1002 throughout the mass container loading-unloading machine 1000, including to the rigid tray container rotator 1008 of the mass container loading-unloading machine 1000. The tray transport feature can comprise any desired transport features, such as, for example, a drive belt, driven wheels, driven rollers, or any other features capable of transporting multiple rigid tray containers 1002, and is configured to move the rigid tray container 1002 throughout the various components of the mass container loading-unloading machine 1000.

The rigid tray container rotator 1008 is configured to change the orientation of the rigid tray containers 1002. In some embodiments, the rigid tray container rotatory 1008 changes the orientation of the rigid tray container 1002 in response to the orientation identified by the tray label reader 1006. The rigid tray container rotator 1008 may comprise a rotating platform, a mechanical arm configured to engage a rigid tray container 1002 and rotate it to a new position, or any other features, device, or system configured to change the orientation of the rigid tray containers 1002. The rigid tray rotator 1008 can rotate a rigid tray container 1002 by any desired amount, including, for example, 20 degrees, 45 degrees, 90 degrees, 180 degrees, 270 degrees, or any other desired or intermediate amount of rotation.

FIG. 10A depicts one embodiment of the rigid tray container aligner 1010 comprising an elongate member angularly disposed relative to the direction of motion of rigid tray containers 1002 caused by the tray transport feature. The positioning of the rigid tray container aligner 1010 enables ninety degree re-orientation of rigid tray containers 1002 by engaging a portion of each rigid tray container 1002 as it moves and thereby aligning the rigid tray container 1002.

The staging area 1012 can be configured to receive the rigid tray containers 1002 and prepare the rigid tray containers 1002 for loading into a mass container 1004. For unloading of a mass container 1004, the staging area 1012 can be configured to unload one or several rigid tray containers 1002 from mass container 1004 and transport this/these rigid tray containers 1002 to the rigid tray container rotator 1008.

The embodiment of a staging area 1012 depicted in FIG. 10A, can be configured for positioning rigid tray containers 1002 in a layer, or an array of rigid tray container 1002. Advantageously, a layer can be loaded into or unloaded from the mass container 1000. As depicted in FIG. 10A, a layer can comprise, in one embodiment, six rigid tray containers 1002.

The staging area 1012 and tray shuttle device 1014 can additionally manipulate a tray with a lid or a layer of trays with lids, and load a layer of rigid tray containers 1002 into a mass container 1004. Advantageously, the manipulation of trays with lids can facilitate the equal distribution of weight of objects placed on top of the layer amongst all of the rigid tray containers 1002 located below the layer.

The mass container loading-unloading machine 1000 can additionally comprise a mass container manipulator 1018. Advantageously, the mass container manipulator 1018 can be configured to allow the manipulation of multiple mass containers 1004 to facilitate loading and/or unloading of the mass containers 1004. Thus, as depicted in FIG. 10B, the mass container manipulator 1018 can be capable of manipulating two mass containers 1004. As also depicted in FIG. 10B, the mass container manipulator 1018 can position the mass containers 1004 to allow loading/unloading of one of the mass containers 1004 and then reposition the mass containers 1004 to allow loading/unloading of the other mass container 1004.

Some embodiments of a rigid tray system can include an apparatus configured for staging stacks of mass containers 800. In some embodiments, a mass container stager 1100 can be configured for staging stacks of mass containers 800. The mass container stager 1100 can comprise a variety of features and components, and can thus have a wide range of dimensions. The mass container stager 1100 can be configured to operate at a range of speeds. In some embodiments, the mass container stager 1100 can be configured to process up to 10,000, up to 50,000, up to 100,000, up to 282,150, up to 500,000, up to 504,000, up to 1,000,000, or up to any other desired number of letters or flats per hour. In some embodiments, the mass container stager 1100 can be configured to process up to 10, up to 20, up to 50, up to 60, up to 100, up to 900, up to 1,000, up to 5,000, or up to any other desired number of rigid tray containers 100 or mass containers 800 per hour. In some embodiments, a mass container stager 1100 can be configured to have a staging capacity of up to 1,000, up to 10,000, up to 40,320, up to 50,000, up to 100,000, up to 225,720, up to 500,000, up to 1,000,000, or up to any other desired number of letters or flats. In some embodiments, a mass container stager 1100 can have a staging capacity of up to 1, up to 5, up to 6, up to 10, up to 20, up to 24, up to 50, up to 100, up to 720, up to 5,000, or up to any other desired number of rigid tray containers 100, staging modules, or mass containers 800.

Figure 11A:
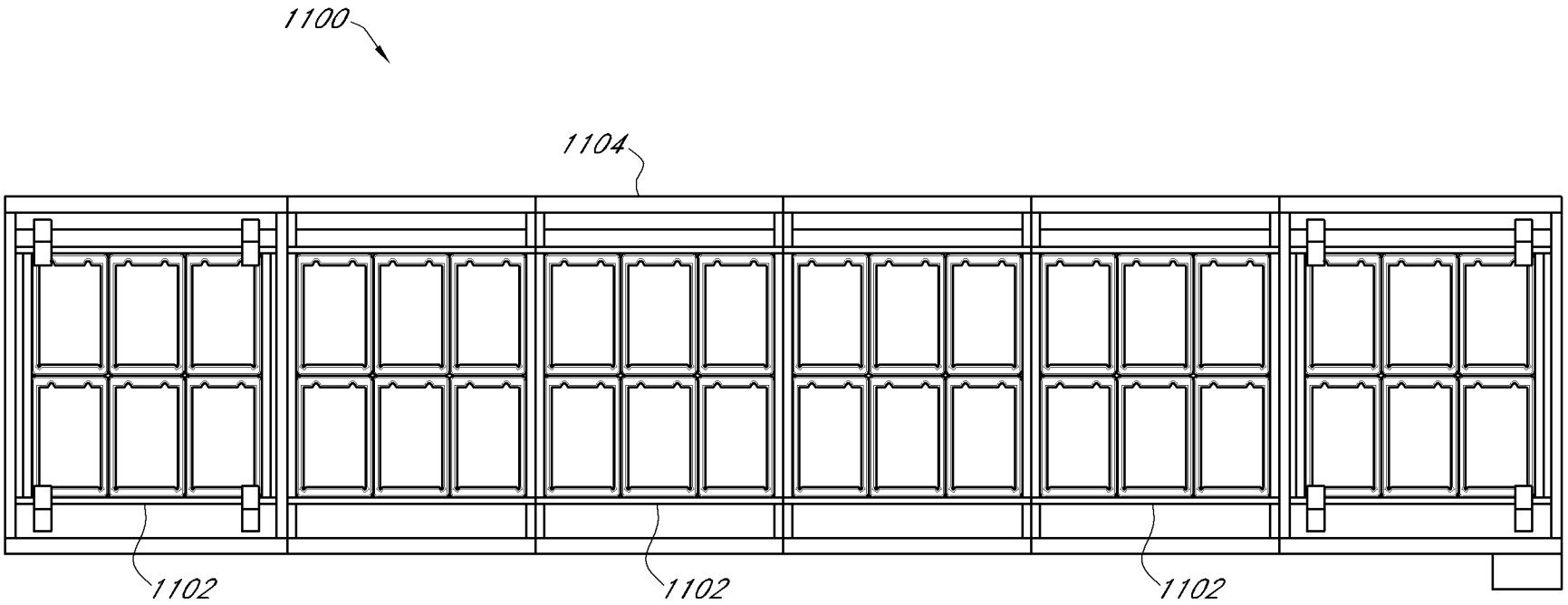
FIG. 11A-11C depict views of one embodiment of a mass container buffer machine.
Figure 11B:
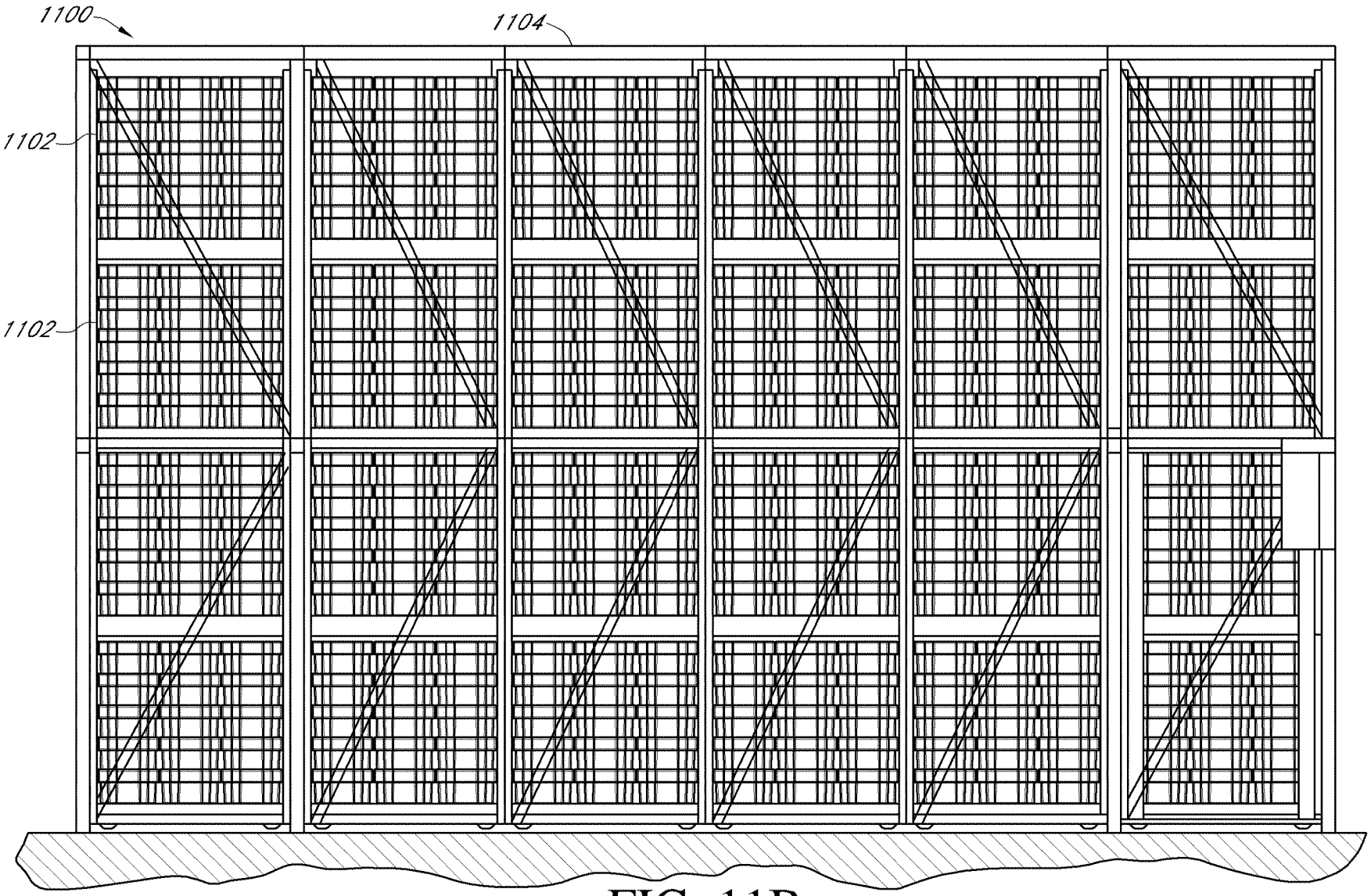
Figure 11C:
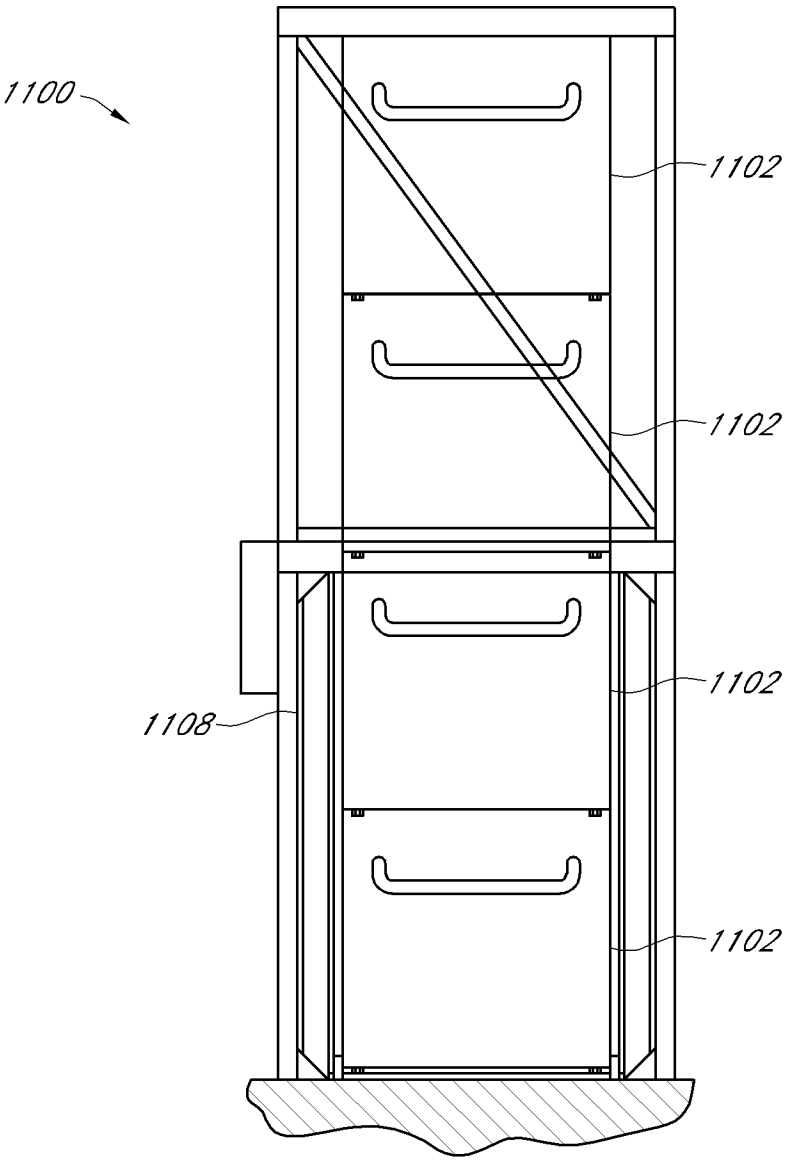

FIG. 11A depicts a top plan view on one embodiment of a mass container stager 1100, FIG. 11B depicts a front elevation view of one embodiment of the mass container stager 1100, and FIG. 11C depicts a side elevation view of one embodiment of the mass container stager 1100. As depicted in FIG. 11B, the mass container stager 1100 can be configured to arrange a plurality of mass containers 1102 into a staging module 1104. The staging module 1104 can comprise a variety of features, dimensions, and attributes. In some embodiments, the staging module 1104 is configured to secure a plurality of mass containers 1102 into a single unit. In some embodiments, the staging module 1104 may comprise a modular or flexible structure to secure multiple mass containers 1102 into a single staging module 1104.

In some embodiments, the mass container stager 1100 can include features to transport one or several mass container stacks to the mass container stager 1100. These features can include, for example, a moving belt, powered rollers, powered wheels, or any other features capable of moving mass containers. In some embodiments, the mass containers 1102 arrive at the mass container stager 1100 pre-stacked into a mass container stack. A mass container stack comprises a stack of at least two mass containers 1102. In some embodiments, however, a mass container stack could include 3, 4, 5, 6, 8, or any other number of stacked mass containers 1102. The mass container stack can include identification identifying the mass container stack. In some embodiments, this identification can be affixed to one or all of the mass containers 1102 in the mass container stack.

The mass container stager 1100 can include a plural stacker 1108 configured to stack at least a first mass container stack on top of a second mass container stack thereby forming a plural stack 1110. In some embodiments, the plural stacker 1108 can be, for example, configured to stack 2, 3, 4, 5, or any other number of mass container stacks into a plural stack. In some embodiments, the mass container stager 1100 can be configured to lift a first mass container stack, to position a second mass container stack under the first mass container stack, and to then stack the first mass container stack on top of the second mass container stack. The plural stack can include identification identifying the plural stack. In some embodiments, this identification can be affixed to one or all of the mass containers 1102 or mass container stacks in the mass container stack.

In some embodiments, the mass container stager 1100 can include features to allow transport of one or several plural stacks 1110 to staging positions. In some embodiments, these transport features can include, for example, a moving belt, powered rollers, powered wheels, or any other features capable of moving one or more plural stacks. In some embodiments, the mass container stager 1100 can include features to allow configuration of plural stacks 1110 or mass container stacks into one or more staging modules 1104.

In some embodiments, the mass container stager 1100 can include features configured to identify a mass container 1102, a mass container stack, a plural stack 1110, a staging module 1104, or any other identifiable feature. In some embodiments, these features can be configured to gather or receive identification information. These features can include, for example, a reader, a scanner, a transmitter, a receiver, or any other feature capable of gathering or receiving identification information from the mass container stager 1100. In some embodiments, the mass container stager 1100 can be configured for adding one or several identification features to a mass container 1102, a mass container stack, a plural stack 1110, or a staging module 1104. In some embodiments, for example, the mass container stager 1100 can comprise features configured to affix computer readable code to a portion of the mass container 1102, mass container stack, plural stack 1110, or staging module 1104. In some embodiments, the mass container stager 1100 can comprise features configured to affix an electronic identification device to a mass container 1102, a mass container stack, a plural stack 1110, or a staging module 1104.

Some embodiments of the rigid tray system can include an apparatus configured for buffering one or several rigid tray containers. A rigid tray buffer machine 1200 can comprise a variety of features and components, and can thus be built to a wide range of dimensions. The rigid tray buffer machine 1200 can be configured to operate at a range of speeds. In some embodiments, the rigid tray buffer machine 1200 can be configured to process up to 10,000, up to 25,000, up to 33,600, up to 50,000, up to 100,000, up to 188,100, up to 500,000, or up to any other desired number of letters or flats per hour. In some embodiments, the rigid tray buffer machine 1200 can be configured to process up to 10, up to 20, up to 50, up to 60, up to 100, up to 600, up to 1,000, up to 5,000, or up to any other desired number of rigid tray containers or mass containers per hour. In some embodiments, the rigid tray buffer machine 1200 can be configured to have a staging capacity of up to 1,000, up to 2,520, up to 10,000, up to 14,107, up to 50,000, up to 100,000, or up to any other desired number of letters or flats. In some embodiments, the rigid tray buffer machine 1200 can have a staging capacity of up to 1, up to 5, up to 6, up to 10, up to 20, up to 45, up to 50, up to 100, or up to any other desired number of rigid tray containers, staging modules, or mass containers.

Figure 12A:
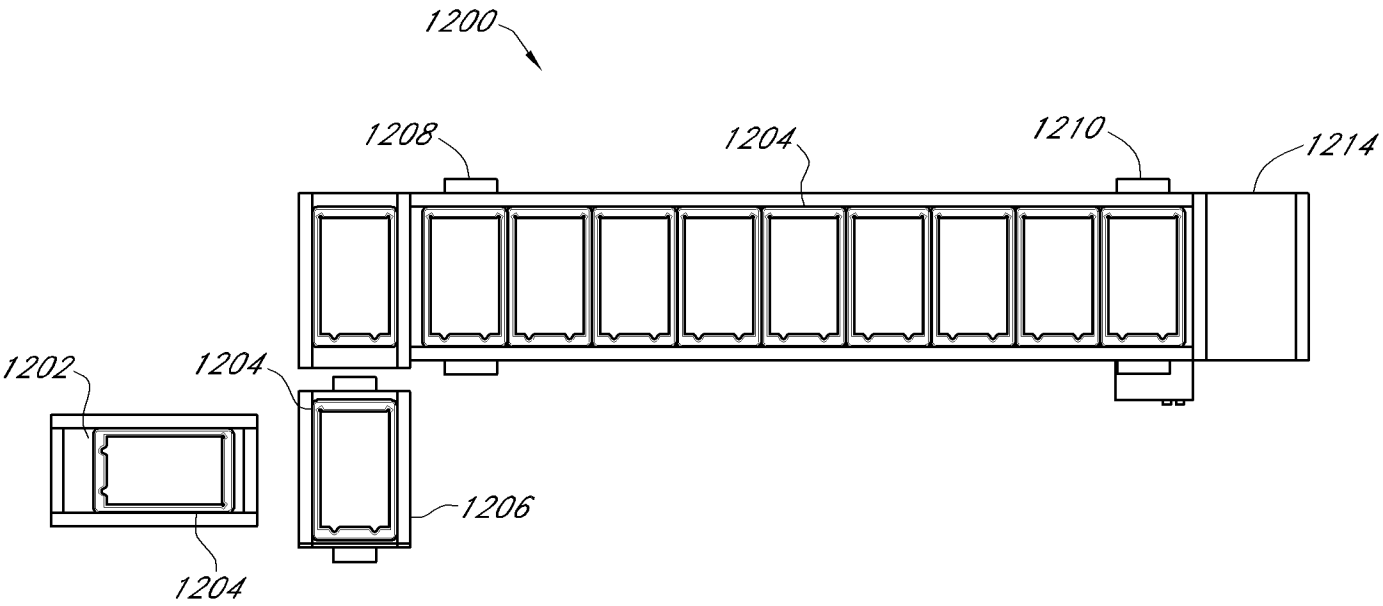
FIG. 12A-12C depict views of one embodiment of a rigid tray buffer machine.
Figure 12C:
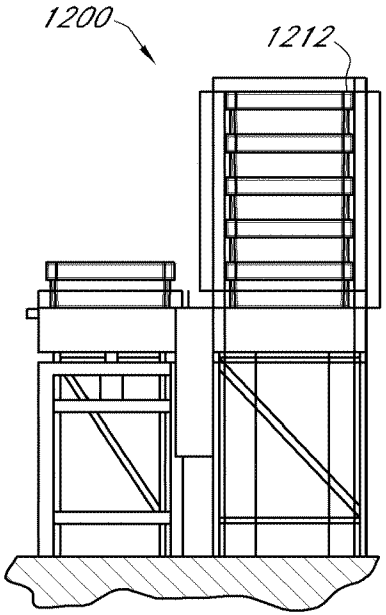
Figure 12B:
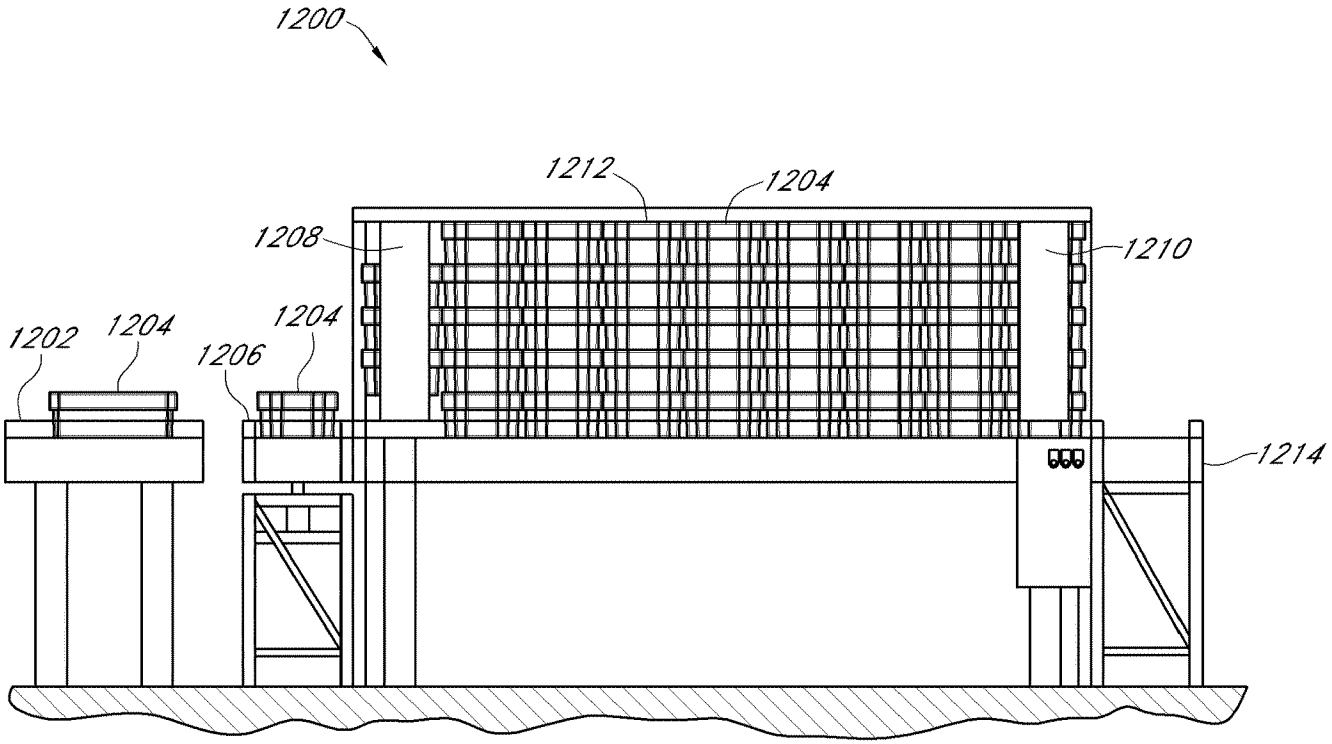

FIG. 12A depicts a top plan view of one embodiment of the rigid tray buffer machine 1200, FIG. 12B depicts a front elevation view of one embodiment of the rigid tray buffer machine 1200, and FIG. 12C depicts a side elevation view of one embodiment of the rigid tray buffer machine 1200. As depicted in FIG. 12B, rigid tray buffer machine 1200 can be configured to receive, to buffer, and to dispense a plurality of mass containers 1204. As depicted in FIG. 12A, a rigid tray buffer machine 1200 can comprise, for example, transport feature 1202 to transport one or several rigid tray containers 1204 to the rigid tray buffer machine 1200, rotator 1206 that rotates rigid tray containers 1204 for stacking, stacker 1208, unstacker 1210, and transport feature 1214. As depicted in FIG. 12*b*, the rigid tray buffer machine 1200 can further comprise, for example, a buffer stack 1212.

Transport features 1202, 1214 can be configured to transport one or several rigid tray containers 1204 to and from the rigid tray buffer machine 1200. In some embodiments, the transport features 1202, 1214 can include, for example, a moving belt, powered rollers, powered wheels, or any other features capable of moving one or more plural stacks.

The rotator 1206 can be configured to rotate rigid tray containers 1204. The rotator 1206 can comprise a variety of features arranged in a variety of configurations. In some embodiments, the rotator 1206 can be configured to rotate one or several rigid tray containers 30 degrees, 45 degrees, 60 degrees, 90 degrees, 120 degrees, 180 degrees, or by any other desired amount. In some embodiments, the rotator 1206 uses electronic, pneumatic, hydraulic, or any other power source to rotate the rigid tray container 1204. In some embodiments, rotator 1206 can be configured to receive one or several rigid tray containers 1204 from transport feature 1202, rotate the rigid tray container 1204 ninety degrees, and transport the rigid tray container 1204 to the stacker 1208.

The stacker 1208 can be configured to stack a plurality of rigid tray containers 1204. In some embodiments, the stacker 1208 is configured to receive a first rigid tray container 1204, lift the first rigid tray container 1204, receive a second rigid tray container 1204 under the first rigid tray container 1204, and set the first rigid tray container 1204 on top of the second rigid tray container 1204. This process can be repeated for any desired number of rigid tray containers 1204. After a stack of rigid tray containers 1204 has reached a desired height, the stacker 1208 can advance the stacked rigid tray containers 1204 to the buffer stack 1212.

The buffer stack 1212 can be configured to create a buffer of rigid tray containers 1204. Advantageously, the buffer stack 1212 can improve processing by facilitating maintenance of a constant throughput and preventing shortfalls of, for example, rigid tray containers 1204. The buffer stack 1212 can be configured to transport stacked rigid tray containers 1204 to an unstacker 1210. In some embodiments, transport of the stacked rigid tray containers 1204 can be performed by, for example, a moving belt, powered rollers, powered wheels, or any other features capable of moving one or more plural stacks.

The unstacker 1210 unstacks stacked rigid tray containers 1204 and transports the unstacked rigid tray containers 1204 to transport feature 1214. In some embodiments, the unstacker 1210 can be configured to receive a stack of rigid tray containers 1204 from the buffer stack 1212, lift all of the rigid tray containers 1204 in the stack, except the bottom most rigid tray container 1204, transport the bottom most rigid tray container 1204 to the transport feature 1214, and set the remaining, stacked rigid tray containers 1204 down. This process can be repeated until each of the rigid tray containers 1204 from the stack has been transported to the transport feature 1214, at which point the unstacker 1210 can be configured to receive a second set of stacked rigid tray containers 1204.

A person of skill in the art will recognize that the above discussed devices can comprise a combination of the features discussed above, including all, or a portion of the above discussed features. A person of skill in the art will further recognize that the above discussed devices can include features additional to those discussed above, and that the above recited disclosure is one non-limiting embodiment of aspects of a rigid tray container based mail system.

Rigid Tray Container Methods

The rigid tray container system, and components thereof, can be used to increase the efficiency of item processing and delivery by allowing batch processing of those items. These items can be any item, including items capable of fitting within a rigid tray container or in a mass container. In some embodiments, these methods are used with items received from a postal facility, and or from a mailer. In some embodiments, the items can be, for example, incoming primary and secondary mail, including, for example, 5 digit and 3 digit mail, collection mail, standard mail, including, for example, 5 digit and 3 digit mail, priority mail, and express mail. In some embodiments, the rigid tray container mail system operating with these methods can, for example, output containers filled with the items. In some embodiments, these rigid tray containers can be filled, for example, with delivery point sequence (DPS) letters or flats, with outgoing mail, with manual letters, with flats for facilities, with flats for AO's, with manual flats, with express mail for facilities, and/or with express mail for AO's.

In some embodiments, methods of batch processing can involve loading and unloading of smaller rigid tray container mail system components into larger components between process steps. Thus, in some embodiments, one or several items may be loaded into one or several rigid tray containers 100, and one or several rigid tray containers 100 may be loaded into one or several mass containers 800. Further, one or several mass containers 80 may be staged together. After loading a smaller component into a larger component, the identification of the smaller component is associated with the identification of the larger component, so that by identifying the location of the larger component, the location of the smaller component is simultaneously determined. Thus, when an item is place within a rigid tray container 100, the item is associated with the rigid tray container 100 such that the determination of the location of the rigid tray container 100 also allows determination of the location of the smaller item without a separate scanning or identification step for the item. Advantageously, batch processing by loading smaller items into larger containers, such as, for example, articles into rigid tray containers 100, can speed processing, decrease wasted resources, ease tracking, and minimize lost articles. In some embodiments, each mail piece is tracked until it is loaded into a rigid tray container 100, at which point the rigid tray container 100 is tracked. In some embodiments, the rigid tray container 100 is tracked until it is loaded into a mass container 800, at which point, the mass container 800 is tracked. In some embodiments, the mass container 800 is tracked until it is staged with other mass containers 800, at which point the staging module 1104 is tracked.

The above disclosed components of the rigid tray container system can be used in a variety of ways in these methods. In some embodiments, all of the above discussed components of the rigid tray container system are used one or several times. In some embodiments, select components of the rigid tray container system are used one or several times. Further, the order in which the above disclosed components of the rigid tray system are used can vary based on the needs of the specific method and other requirements, such as, for example, facility size.

Methods of batch processing with the rigid tray container system can include devices other than the above discussed components of the rigid tray container system. These can include, for example, sorting devices, scanning devices, separation devices, or any other required device. In some embodiments, these devices can include, for example, an advanced facer cancellation system (AFCS), a delivery bar code sorter (DBCS), including a primary, secondary, and/or dual pass DBCS, an advanced flat sorting machine (AFSM), including a primary and/or secondary AFSM, and/or an automated package processing system (APPS/APBS).

Figure 13:
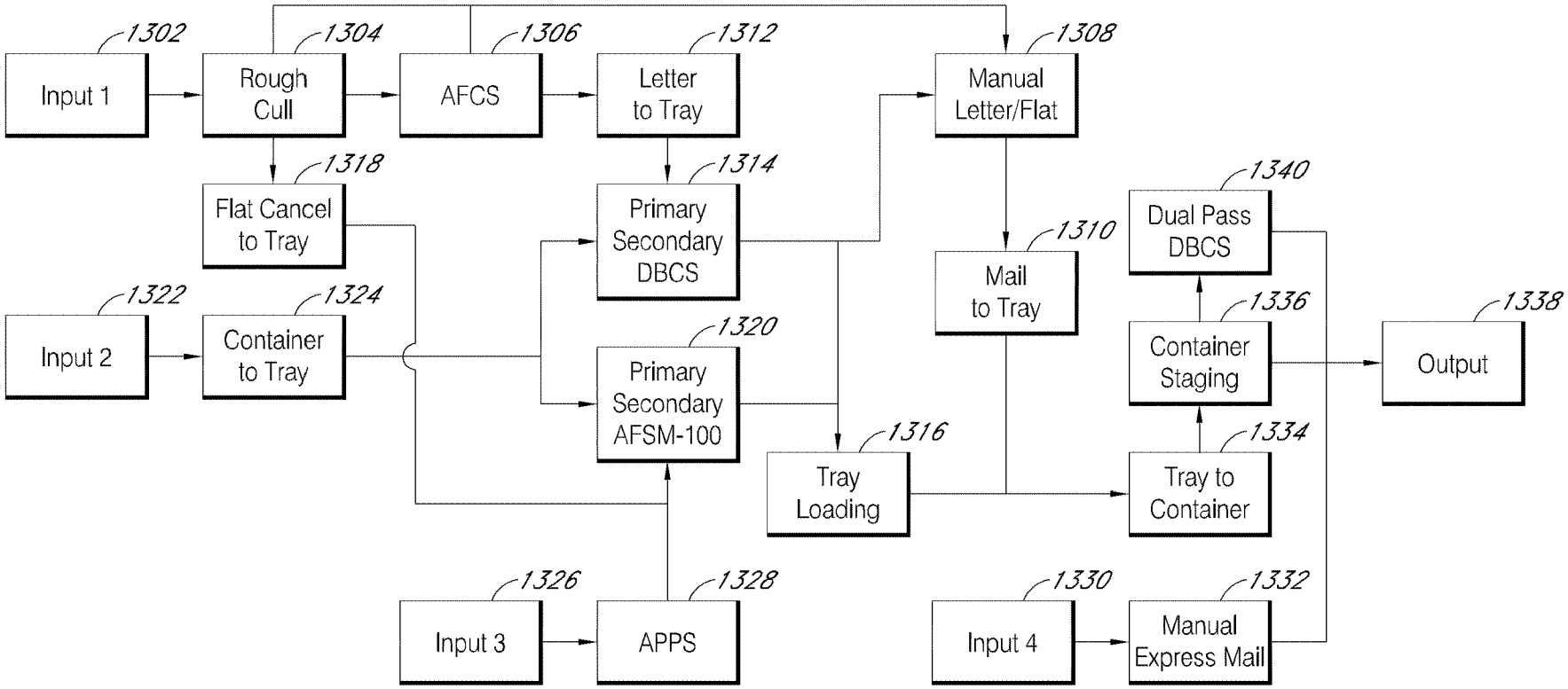
FIG. 13 is a flow chart illustrating one method of consolidated batch processing.

FIG. 13 depicts one embodiment of a method of use of a rigid tray container system in a process. As depicted in FIG. 13, different inputs can be received. In some embodiments, these inputs represent different types of mail, such as, for example, letters, flats, and/or packages. In some embodiments, these different inputs can represent different classes of mail, such as, for example, express, priority, three day, five day, first class, or any other mail class. In some embodiments, these inputs are received from different sources, such as, for example, from other processing facilities, from mail stations, and/or from a mailer. As depicted in FIG. 13, a first input is received at block 1302 is transported to a rough cull at block 1304. In some embodiments, the rough cull can remove mail that does not conform to certain requirements. In some embodiments, this mail can be, for example, undeliverable, improperly addressed, and/or improperly packaged. In some embodiments, the rough cull can sort mail types, such as, for example, flats from letters. In some embodiments, the rough cull can designate some articles, including, for example, letters and/or flats, for manual processing at block 1308. After processing, these articles can be loaded into a rigid tray container 100 at block 1310.

Returning now to the rough cull at block 1304, in some embodiments, the rough cull can transport articles to the AFCS at block 1306. In some the AFCS can designate some articles, including, for example, letters and/or flats, for manual processing at block 1308. After processing, these articles can be loaded into a rigid tray container 100 at block 1310. In other embodiments, after passing the AFCS, the articles can be loaded into a rigid tray container 100 at block 1312. The rigid tray container 100 is transported to a primary secondary DBCS at block 1314. In some embodiments, the articles can be unloaded from the rigid tray container 100 and passed through the DBCS, and in other embodiments, the entire rigid tray container 100 can pass through the DBCS. After pass through the DBCS, the articles, if they were unloaded from the rigid tray container 100, can be loaded into a rigid tray container 100 at block 1316. In some alternative embodiments, articles are delivered from block 1214 to block 1308 for manual processing. These articles are then loaded into a rigid tray container 100 at block 1310.

Returning again to the rough cull at block 1304, in some embodiments, some articles are loaded into a tray at block 1318. The articles can be, for example, already cancelled flats. The rigid tray container 100 can be transported to a primary secondary AFSM, and in some embodiments, a primary secondary AFSM-100, at block 1320. The articles can be unloaded from the rigid tray container 100, and processed through the AFSM. After which time, the articles can be loaded into a rigid tray container 100 at block 1316.

In some embodiments, a second input 1322 is received. This input can be received from mail carriers, from mailers, or from another mailing facility. In some embodiments, this input is received in one or several mass containers 800. At block 1324, one or several rigid tray containers 100 are removed from one or several mass containers 800. One or several of these rigid tray containers 100 are delivered to a primary secondary DBCS at block 1314 and/or a primary secondary AFSM machine at block 1320, where the articles are unloaded from the one or several rigid tray containers 100. After processing, the articles are loaded into a rigid tray container 100 at block 1316 or transported to block 1308 for manual processing, after which processing the articles are loaded into a rigid tray container 100 at block 1310.

In some embodiments, a third input is received at block 1326. These articles are processed by an APPS at block 1328, and by a primary secondary AFSM at block 1320. These articles are then loaded into a rigid tray container 100 at block 1316.

In some embodiments, a fourth input is received at block 1330. In some embodiments, these articles can be, for example, articles of express mail. In some embodiments, these articles are manually loaded into a rigid tray container 100 at block 1332.

Returning now to articles loaded into rigid tray containers 100 at blocks 1310, 1316, the rigid tray containers 100 are loaded into a mass container 800 at block 1334. At block 1336, the mass containers 800 are staged for delivery. The staged mass containers 800 can be transported to a dual pass DBCS at block 1340 and then be delivered as an output at block 1338, or the staged containers 800 can be directly delivered as an output at block 1338.

Figure 14:
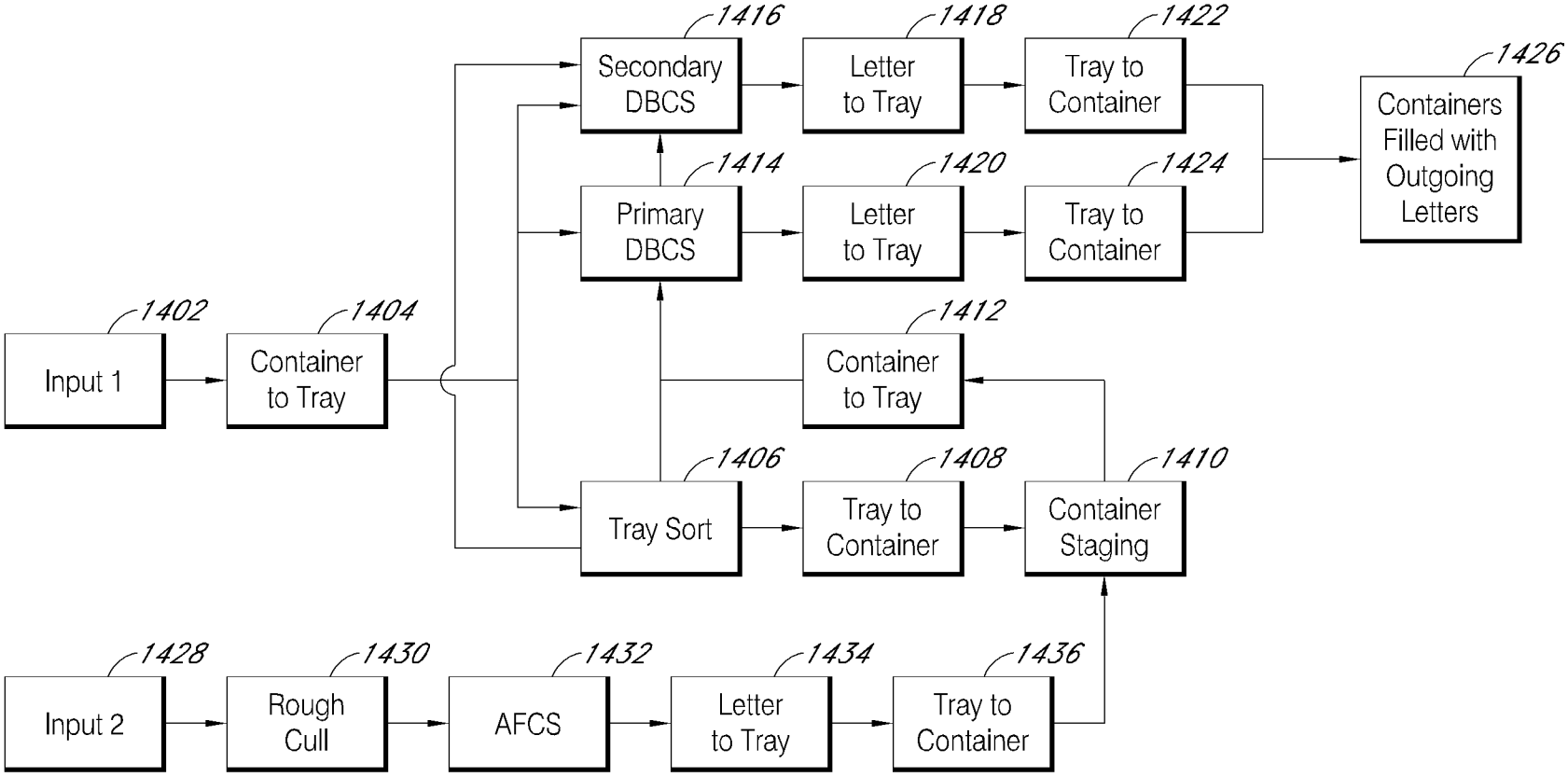
FIG. 14 is a flow chart illustrating one method of batch processing for three and five digit letters being sent to other mailing facilities.

FIG. 14 depicts one embodiment of a method of use of a rigid tray container 100 system in a process. Specifically, FIG. 14 depicts a rigid tray processing method for three and five digit letters being prepared to be sent to another mail facility. As depicted in FIG. 14, different inputs can be received. In some embodiments, these inputs represent different types of mail, such as, for example, letters, flats, and/or packages. In some embodiments, these different inputs can represent different classes of mail, such as, for example, express, priority, three day, five day, first class, or any other mail class. In some embodiments, these inputs are received from different sources, such as, for example, from mail station and/or from a mailer. As depicted in FIG. 14, a first input is received at block 1402 is transported to block 1404 where one or more rigid tray containers 100 are unloaded from a mass container 800. In some embodiments, rigid tray containers 100 are sorted at block 1406, are loaded into a mass container 800 at block 1408, and are staged at block 1410. In addition to first inputs being staged at block 1410, in some embodiments, a second input, which can include, for example, mail pieces, can be received at block 1428, can pass through a rough cull at block 1430, and can be delivered to an AFCS at block 1432. After passing through the AFCS, the articles of the first input can be loaded into a rigid tray container 100 at block 1434, the rigid tray containers 100 can be loaded into a mass container 800 at block 1436, and the mass containers 800 can be staged at block 1410. The mass container 800 can then be transported to another location and the rigid tray containers 100 can be unloaded from the mass container 800 at block 1412. In another embodiment, rigid tray containers 100 are transferred from blocks 1404, 1412 to a primary DBCS block 1414 or a secondary DBCS block 1416. In some embodiments, the rigid tray containers 100 are processed by the primary and secondary DBCS. In some embodiments, one or more mail pieces are unloaded from the rigid tray containers 100 and then processed by the DBCS. In some embodiments, the primary DBCS can additionally pass mail pieces to the secondary DBCS. After processing by the primary and/or secondary DBCS, mail pieces pass to block 1418 and/or 1420, where the mail pieces are loaded into one or more rigid tray containers 100. The rigid tray containers 100 are then loaded into one or more mass containers at block 1422 and/or block 1424, and are delivered as system outputs and block 1426.

Figure 15:
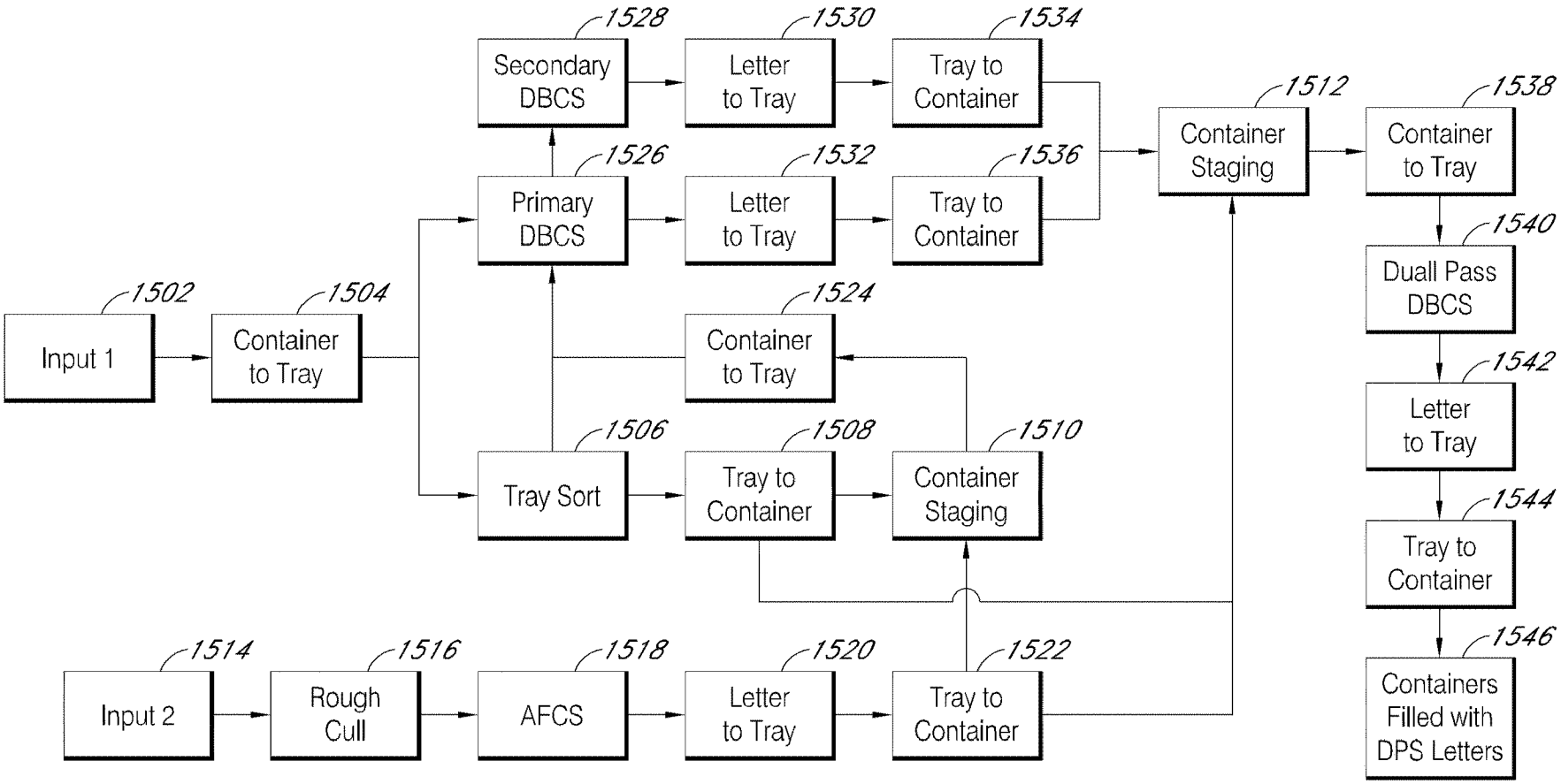
FIG. 15 is a flow chart illustrating one method of batch processing for DPS letters being sent to Associate Offices or Delivery Offices (AOs).

FIG. 15 depicts one embodiment of a method of use of a rigid tray container mailing system in a mail process. Specifically, FIG. 15 depicts a rigid tray mail processing method for DPS letters being prepared to be sent to an AO. As depicted in FIG. 15, different inputs can be received. In some embodiments, these inputs represent different types of mail, such as, for example, letters, flats, and/or packages. In some embodiments, these different inputs can represent different classes of mail, such as, for example, express, priority, three day, five day, first class, or any other mail class. In some embodiments, these inputs are received from different sources, such as, for example, from mail station and/or from a mailer. As depicted in FIG. 15, a first input is received at block 1502. In some embodiments, this input is contained in one or more rigid tray containers loaded 100 into one or more mass containers 800. In some embodiments, the rigid tray containers 100 are unloaded from the mass container 800 at block 1504. In some embodiments, the rigid tray containers 100 are sorted at block 1506, loaded into one or several mass containers 800 at block 1508, and staged at block 1510 or block 1512. In some embodiments, a second input, which can comprise, for example, collected mail pieces, is received at block 1514. The second input passes a rough cull at block 1516, an AFCS at block 1518, and is loaded into one or several rigid tray containers 100 at block 1520. The one or several rigid tray containers 100 can then be loaded into one or several mass containers 800 at block 1522, which mass containers 800 are staged at one of blocks 1510 or 1512.

After transport, in some embodiments, rigid tray containers 100 that were in mass containers 800 that were staged at block 1510 are unloaded from the mass containers 800 at block 1524. In some embodiments, rigid tray containers 100 from block 1504 or from block 1524 are delivered to a primary DBCS at block 1526. The rigid tray containers 100 can be passed through the primary DBCS, or the one or mail pieces contained in the rigid tray containers 100 can be unloaded and passed through the primary DBCS. The primary DBCS can transfer either rigid tray containers 100 or letters to the secondary DBCS at block 1528 for further processing. After processing by one or both of the primary and secondary DBCS, the processed mail pieces are loaded into a rigid tray container 100 at block 1539, 1532, the rigid tray containers 100 are loaded into one or more mass containers 800 at blocks 1534, 1536, and the mass containers 800 are staged at block 1512.

In some embodiments, the staged mass containers 800 are transported to another position, block 1538, where the rigid tray containers 100 are unloaded from the mass container 800. The rigid tray containers 100 are transported to a dual pass DBCS at block 1540, at which point the mail pieces are unloaded from the rigid tray container 100 and are passed through the DBCS. The mail pieces are then loaded into a rigid tray container 100 at block 1542, the rigid tray containers 100 are loaded into a mass container 800 at 1544, and the mass containers 800 are delivered as an output at block 1546.

Figure 16:
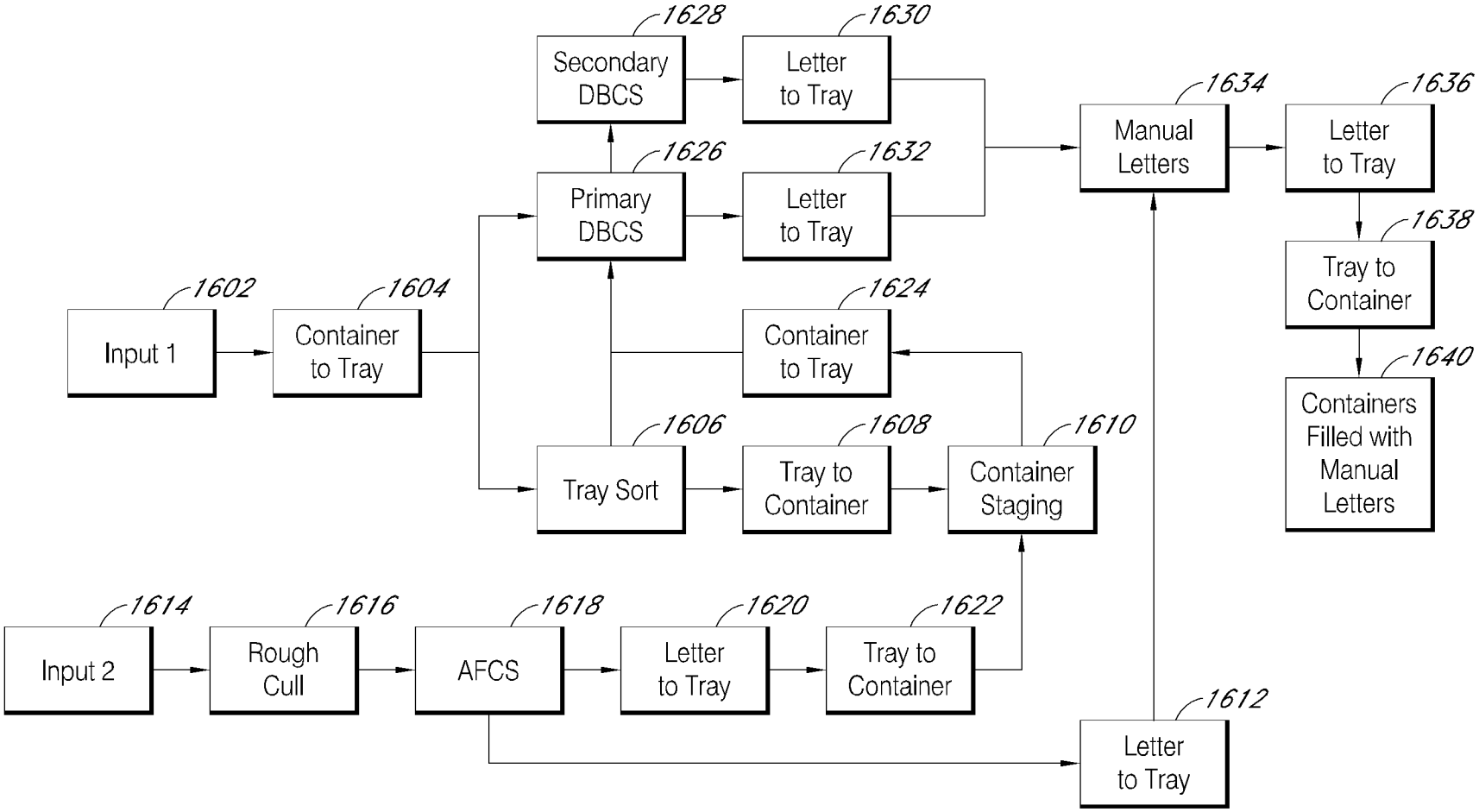
FIG. 16 is a flow chart illustrating one method of batch processing for manual letters being sent to AOs.

FIG. 16 depicts one embodiment of a method of use of a rigid tray container mailing system in a mail process. Specifically, FIG. 16 depicts a rigid tray mail processing method for manual letters being prepared to be sent to an AO. As depicted in FIG. 16, different inputs can be received. In some embodiments, these inputs represent different types of mail, such as, for example, letters, flats, and/or packages. In some embodiments, these different inputs can represent different classes of mail, such as, for example, express, priority, three day, five day, first class, or any other mail class. In some embodiments, these inputs are received from different sources, such as, for example, from mail station and/or from a mailer. As depicted in FIG. 16, a first input is received at block 1602. In some embodiments, this input is contained in one or more rigid tray containers 100 loaded into one or more mass containers 800. In some embodiments, the rigid tray containers 100 are unloaded from the mass container 800 at block 1604. In some embodiments, the rigid tray containers 100 are sorted at block 1606, loaded into one or several mass containers 800 at block 1608, and staged at block 1610. In some embodiments, a second input, which can comprise, for example, collected mail pieces, is received at block 1614. The second input passes a rough cull at block 1616, and an AFCS at block 1618. In some embodiments, mail pieces from the AFCS are loaded into a rigid tray container 100 at block 1612, and are manually processed at block 1634. In some embodiments, mail pieces from the AFCS are loaded into one or several rigid tray containers 100 at block 1620, which one or several rigid tray containers 100 can be loaded into one or several mass containers 800 at block 1622, and which mass containers 800 are staged at block 1610.

After transport, in some embodiments, the rigid tray containers 100 that were in the mass containers 800 that were staged at block 1610 are unloaded from the mass containers 800 at block 1624. In some embodiments, the rigid tray containers 100 from block 1604 or from block 1624 are delivered to a primary DBCS at block 1626. The rigid tray containers 100 can be passed through the primary DBCS, or the one or mail pieces contained in the rigid tray containers 100 can be unloaded and passed through the primary DBCS. The primary DBCS can transfer either the rigid tray containers 100 or letters to the secondary DBCS at block 1628 for further processing. After processing by one or both of the primary and secondary DBCS, the processed mail pieces are loaded into one or several rigid tray containers 100 at block 1630, 1632, the rigid tray containers 100 are delivered for manual processing at block 1634, along with rigid tray container 100 received from block 1612. The mail pieces are then loaded into a rigid tray container 100 at block 1636, the rigid tray containers 100 are loaded into a mass container 800 at 1638, and the mass containers 800 are delivered as an output at block 1640.

Figure 17:
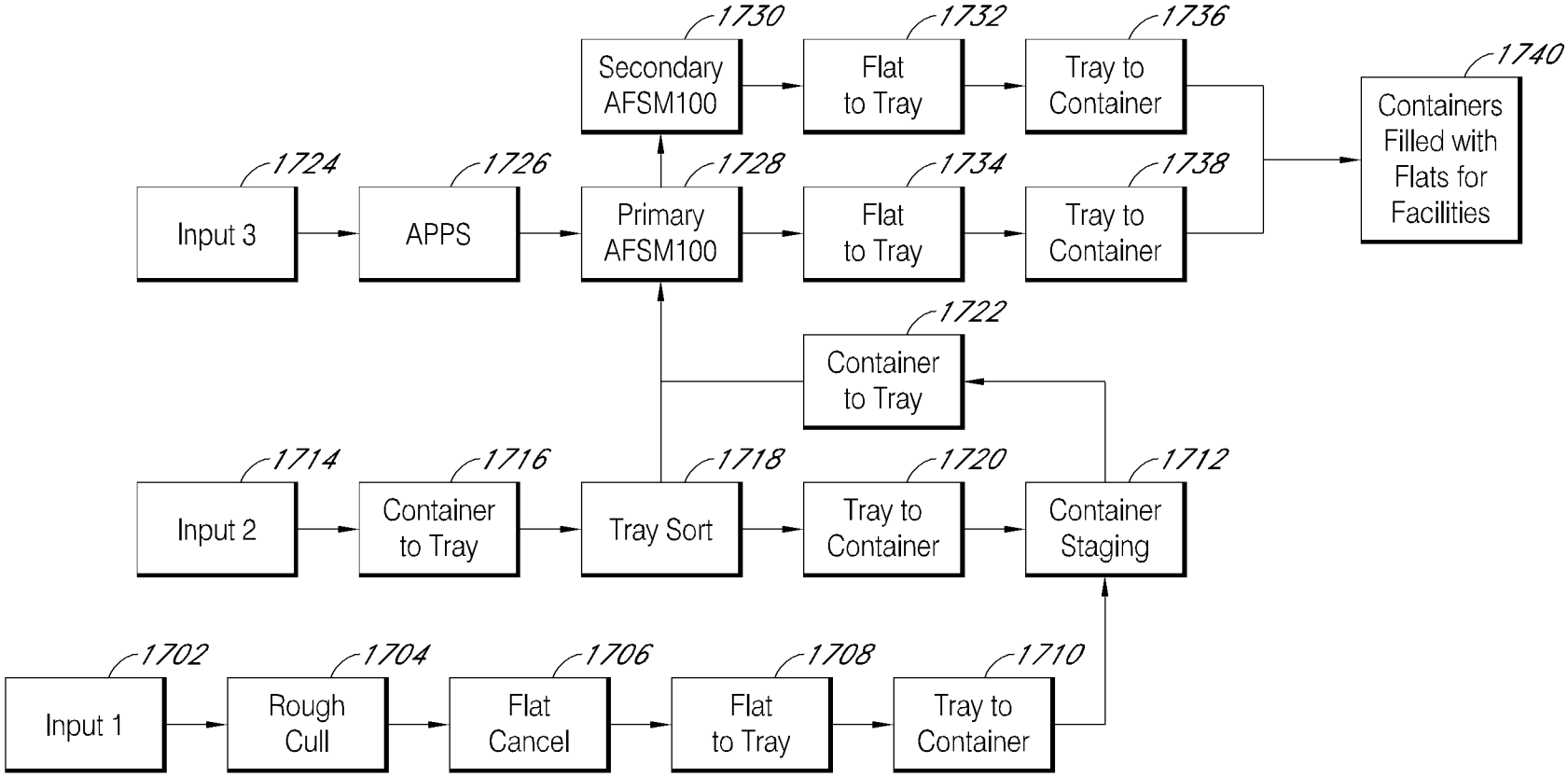
FIG. 17 is a flow chart illustrating one method of batch processing for five digit flats being sent to other mailing facilities.

FIG. 17 depicts one embodiment of a method of use of a rigid tray container mailing system in a mail process. Specifically, FIG. 17 depicts a rigid tray mail processing method for 5 digit flats being prepared to be sent to another mail facility or to an AO. As depicted in FIG. 17, different inputs can be received. In some embodiments, these inputs represent different types of mail, such as, for example, letters, flats, and/or packages. In some embodiments, these different inputs can represent different classes of mail, such as, for example, express, priority, three day, five day, first class, or any other mail class. In some embodiments, these inputs are received from different sources, such as, for example, from mail station and/or from a mailer. As depicted in FIG. 17, a first input is received at block 1702. In some embodiments, the first input, can comprise, for example, collected articles, such as mail pieces. The first input passes a rough cull at block 1704 and through flat cancellation at 1706. The flats are loaded into one or several rigid tray containers 100 at 1708, which rigid tray containers 100 are loaded into a mass container 800 at block 1710, and delivered for staging at block 1712.

As also depicted in FIG. 17, a second input comprising one or more mass containers 800 holding one or more rigid tray containers 100 and one or more flats can be received at block 1714. The rigid tray containers 100 can be unloaded from the mass containers 800 at block 1716 and can be sorted at block 1718. The sorted rigid tray containers 100 can be loaded into a mass container 800 at block 1720, which mass containers 800 can be staged at block 1712. The staged mass containers 800 at block 1712, including first and second inputs, can be transported to a second location in the processing facility, at which time, one or more rigid tray containers 100 can be unloaded from the mass containers 800 as shown at block 1722.

A third input can be received at block 1724. This input can be processed through an APPS at block 1726. A primary AFSM at block 1728 can be configured to receive and process flats from the first, second, and third inputs. The primary AFSM can transfer some or all of the flats to a secondary AFSM for processing at block 1730. After processing by one or both of the primary and secondary AFSM, mail pieces are loaded into one or several rigid tray containers at blocks 1732, 1734, which are then loaded into one or several mass containers 800 at block 1736, 1738. These mass containers 800 are delivered as an output at block 1740. In some embodiments, these mass containers 800 are configured for delivery to another mail facility, or for an AO.

Figure 18:
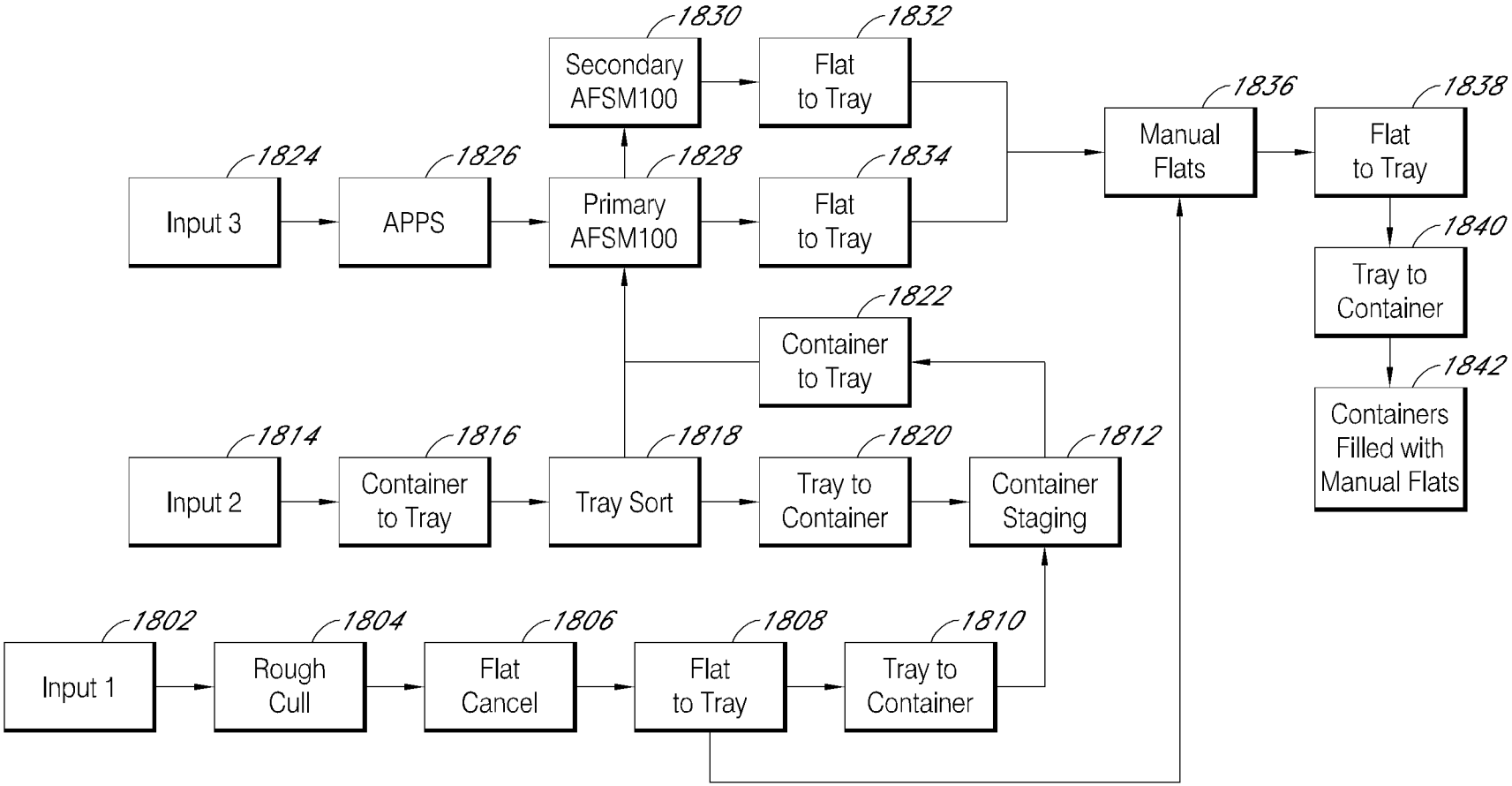
FIG. 18 is a flow chart illustrating one method of batch processing for manual flats being sent to AOs.

FIG. 18 depicts one embodiment of a method of use of a rigid tray container mailing system in a mail process. Specifically, FIG. 18 depicts a rigid tray mail processing method for manual flats being prepared to be sent to an AO. As depicted in FIG. 18, different inputs can be received. In some embodiments, these different inputs can represent different classes of flats, such as, for example, express, priority, three day, five day, first class, or any other mail class. In some embodiments, these inputs are received from different sources, such as, for example, from mail station and/or from a mailer. As depicted in FIG. 18, a first input is received at block 1802. In some embodiments, the first input, can comprise, for example, collected mail pieces. The first input passes a rough cull at block 1804 and through flat cancellation at 1806. The flats are loaded into one or several rigid tray containers 100 at 1808. In some embodiments, the one or several rigid tray containers 100 at block 1804 can be sent to block 1836 for manual processing, or to block 1810, where the rigid tray containers 100 are loaded into a mass container 800, and delivered for staging at block 1812.

As also depicted in FIG. 18, a second input comprising one or more mass containers 800 holding one or more rigid tray containers 100 and one or more flats can be received at block 1814. The rigid tray containers 100 can be unloaded from the mass containers 800 at block 1816 and can be sorted at block 1818. The sorted rigid tray containers 100 can be loaded into a mass container 800 at block 1820, which mass containers 800 can be staged at block 1812. The staged mass containers 800 at block 1812, including first and second inputs, can be transported to a second location in the processing facility, at which time, one or more rigid tray containers 100 can be unloaded from the mass containers 800 as shown at block 1822.

A third input can be received at block 1824. This input can be processed through an APPS at block 1826. A primary AFSM at block 1828 can be configured to receive and process flats from the first, second, and third inputs. The primary AFSM can transfer some or all of the flats to a secondary AFSM for processing at block 1830. After processing by one or both of the primary and secondary AFSM, mail pieces are loaded into one or several rigid tray containers 100 at blocks 1832, 1834, which are then delivered to block 1836 for manual processing. Processed flats leave the manual processing at block 1836 and are loaded into one or several rigid tray containers 100 at block 1838, which rigid tray containers 100 are loaded into one or several mass 800 containers at block 1840. These mass containers 800 are delivered as an output at block 1842. In some embodiments, these mass containers 800 are configured for delivery to an AO.

Figure 19:
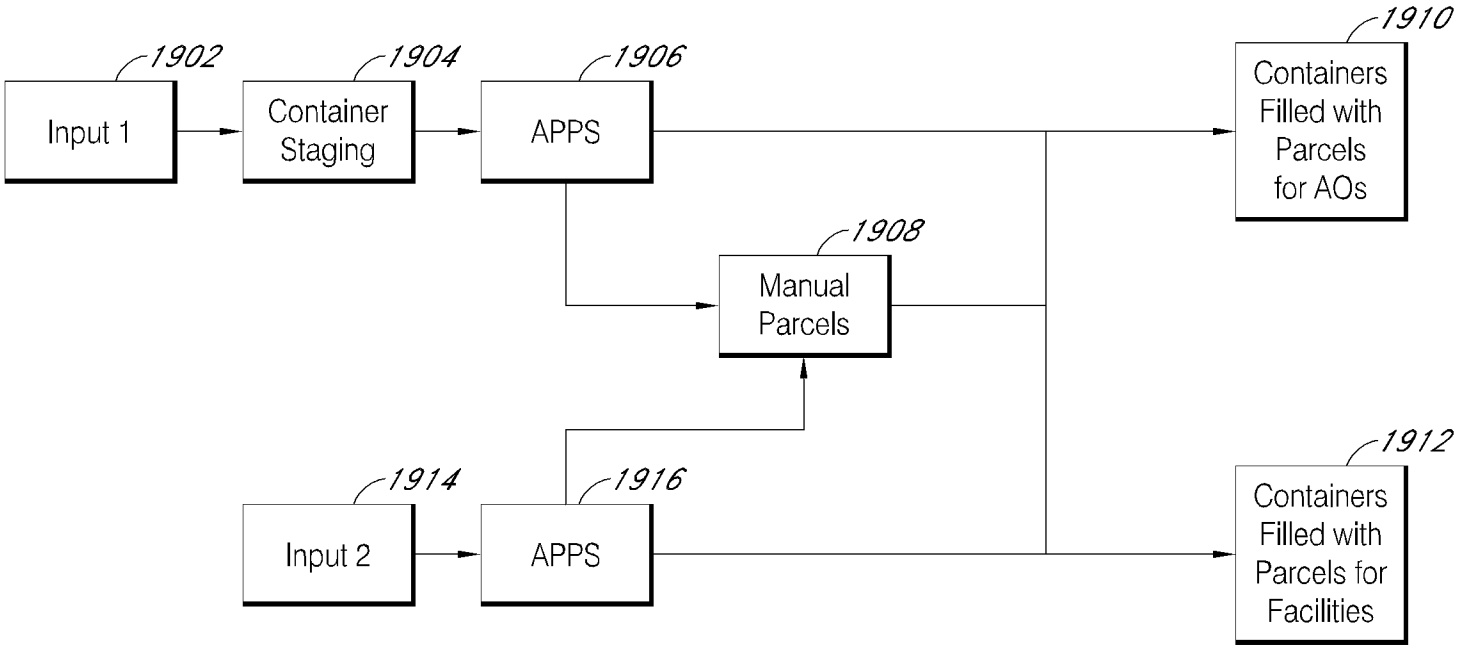
FIG. 19 is a flow chart illustrating one method of batch processing for parcels.

FIG. 19 depicts one embodiment of a method of use of a rigid tray container mailing system in a mail process. Specifically, FIG. 19 depicts a rigid tray mail processing method for parcels being prepared to be sent to an AO or to another mail facility. As depicted in FIG. 19, different inputs can be received. In some embodiments, these different inputs can represent different classes of parcels, such as, for example, express, priority, three day, five day, first class, or any other mail class. In some embodiments, these inputs are received from different sources, such as, for example, from mail station and/or from a mailer. As depicted in FIG. 19, a first input is received at block 1902. In some embodiments, the first input, can comprise, for example, collected parcels loaded in one or several mass containers 800. The mass containers 800 of the first input are staged at block 1904. After staging, the mass containers 800 pass through an APPS at block 1906. From the APPS, parcels can be given manual processing as required at block 1908 and then delivered as an out for AOs at block 1910 and as an output for another facility at block 1912.

FIG. 19 further depicts a second input received 1914. In some embodiments, the second input can comprise collected priority mail. The second input is delivered to an APPS at block 1916. From the APPS, parcels can be given manual processing as required at block 1908 and then delivered as an out for AOs at block 1910 or as an output for another facility at block 1912.

Figure 20:
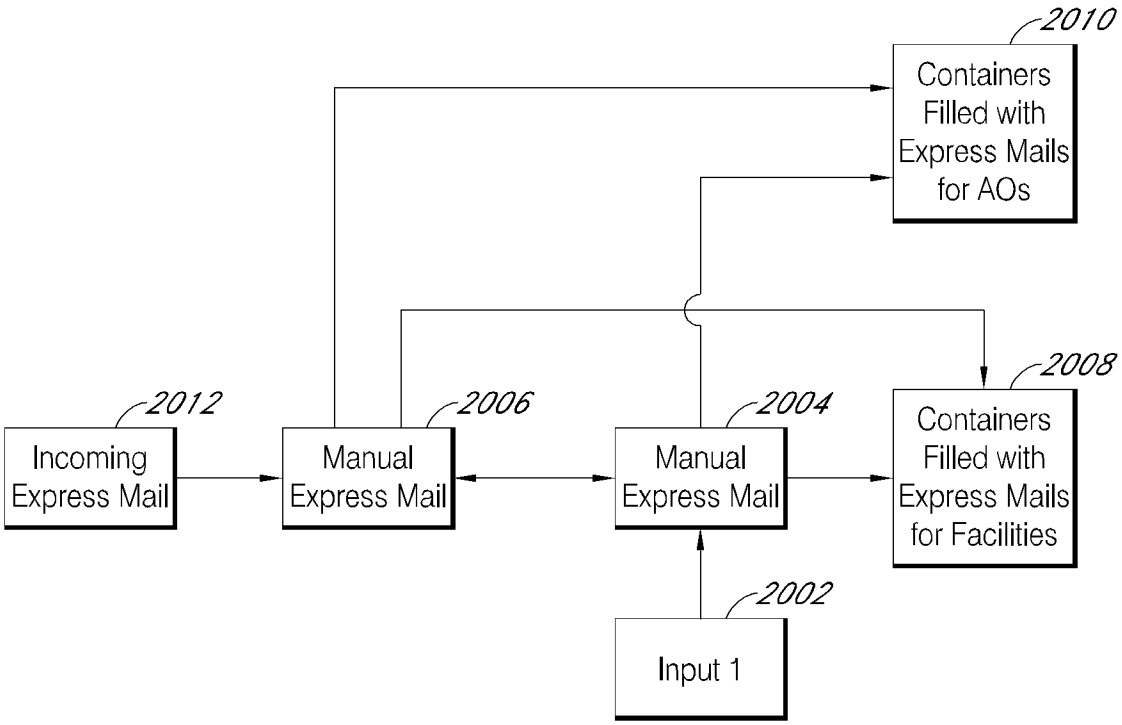
FIG. 20 is a flow chart illustrating one method of batch processing for express mail.

FIG. 20 depicts one embodiment of a method of use of a rigid tray container mailing system in a mail process. Specifically, FIG. 20 depicts a rigid tray mail processing method for express mail being prepared to be sent to an AO or to another mail facility. As depicted in FIG. 20, different inputs can be received. In some embodiments, these inputs are received from different sources, such as, for example, from mail station and/or from a mailer. As depicted in FIG. 20, a first input is received at block 2002. In some embodiments, the first input can be collection express mail. The first input is delivered for manual processing at block 2004. If additional manual processing is required, the first input is delivered to block 2006 for further manual processing. After receiving manual processing, the first input is delivered in filled containers as an output for other mail facilities at block 2008 or in filled containers as an output for AOs at block 2010.

In some embodiments a second input is received at block 2012. In some embodiments, the second input can be incoming express mail received from other facilities. The second input is delivered for manual processing at block 2006. If additional manual processing is required, the first input is delivered to block 2004 for additional manual processing. After receiving manual processing, the second input is delivered in filled containers as an output for other mail facilities at block 2008 or in filled containers as an output for AOs at block 2010.

A person skilled in the art will recognize that each of these sub-systems can be inter-connected and controllably connected using a variety of techniques and hardware and that the present disclosure is not limited to any specific method of connection or connection hardware.

The technology is operational with numerous other general purpose or special purpose computing system environments or configurations. Examples of well known computing systems, environments, and/or configurations that may be suitable for use with the invention include, but are not limited to, personal computers, server computers, hand-held or laptop devices, multiprocessor systems, microprocessor-based systems, programmable consumer electronics, Programmable or Graphic Logic Controllers, network PCs, minicomputers, mainframe computers, distributed computing environments that include any of the above systems or devices, and the like.

As used herein, instructions refer to computer-implemented steps for processing information in the system. Instructions can be implemented in software, firmware or hardware and include any type of programmed step undertaken by components of the system.

A microprocessor may be any conventional general purpose single- or multi-chip microprocessor such as a Pentium® processor, a Pentium® Pro processor, a 8051 processor, a MIPS® processor, a Power PC® processor, or an Alpha® processor. In addition, the microprocessor may be any conventional special purpose microprocessor such as a digital signal processor or a graphics processor. The microprocessor typically has conventional address lines, conventional data lines, and one or more conventional control lines.

The system may be used in connection with various operating systems such as Linux®, UNIX® or Microsoft Windows®.

The system control may be written in any conventional programming language such as C, C++, BASIC, Pascal, or Java, and ran under a conventional operating system. C, C++, BASIC, Pascal, Java, and FORTRAN are industry standard programming languages for which many commercial compilers can be used to create executable code. The system control may also be written using interpreted languages such as Perl, Python or Ruby.

The foregoing description details certain embodiments of the systems, devices, and methods disclosed herein. It will be appreciated, however, that no matter how detailed the foregoing appears in text, the systems, devices, and methods can be practiced in many ways. As is also stated above, it should be noted that the use of particular terminology when describing certain features or aspects of the invention should not be taken to imply that the terminology is being redefined herein to be restricted to including any specific characteristics of the features or aspects of the technology with which that terminology is associated.

It will be appreciated by those skilled in the art that various modifications and changes may be made without departing from the scope of the described technology. Such modifications and changes are intended to fall within the scope of the embodiments. It will also be appreciated by those of skill in the art that parts included in one embodiment are interchangeable with other embodiments; one or more parts from a depicted embodiment can be included with other depicted embodiments in any combination. For example, any of the various components described herein and/or depicted in the Figures may be combined, interchanged or excluded from other embodiments.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

All references cited herein are incorporated herein by reference in their entirety. To the extent publications and patents or patent applications incorporated by reference contradict the disclosure contained in the specification, the specification is intended to supersede and/or take precedence over any such contradictory material.

The term "comprising" as used herein is synonymous with "including," "containing," or "characterized by," and is inclusive or open-ended and does not exclude additional, unrecited elements or method steps.

All numbers expressing quantities of ingredients, reaction conditions, and so forth used in the specification and claims are to be understood as being modified in all instances by the term "about." Accordingly, unless indicated to the contrary, the numerical parameters set forth in the specification and attached claims are approximations that may vary depending upon the desired properties sought to be obtained by the present invention. At the very least, and not as an attempt to limit the application of the doctrine of equivalents to the scope of the claims, each numerical parameter should be construed in light of the number of significant digits and ordinary rounding approaches.

The above description discloses several methods and materials of the present invention. This invention is susceptible to modifications in the methods and materials, as well as alterations in the fabrication methods and equipment. Such modifications will become apparent to those skilled in the art from a consideration of this disclosure or practice of the invention disclosed herein. Consequently, it is not intended that this invention be limited to the specific embodiments disclosed herein, but that it cover all modifications and alternatives coming within the true scope and spirit of the invention as embodied in the attached claims.

What is claimed is:

1. A mass container system comprising:

a first mass container comprising:

a first side, the first side comprising a first indexing feature;

a second side opposite the first side;

a third side;

a fourth side opposite the third side, wherein the third and fourth sides are moveably connected to the first side and the second side;

a bottom connected to the first side and the second side, the bottom comprising a second indexing feature configured to interact with the first indexing feature on a first side of another mass container to allow stacking of mass containers;

wherein the first side, the second side, the third side, and the fourth side are arranged to bound a volume, the volume configured to receive a plurality of trays;

a second mass container comprising a first side having a first indexing feature and a bottom comprising an indexing feature; and a mass container stacker configured to stack the second mass container on the first mass container.

2. The system of claim 1, wherein the mass container stacker is configured to align the first indexing feature on the first side of the first mass container with the second indexing feature on the bottom of the second mass container when the second mass container is stacked on the first mass container.

3. The system of claim 1, further comprising a mass container stager, the mass container stager comprising securing members to secure the first and second mass containers into a single unit intended for movement to the same destination.

4. The system of claim 1, wherein the moveable connection between the third and fourth sides is a removable connection.

5. The system of claim 4, wherein the third and fourth sides can be removed from the first mass container to allow for loading the plurality of trays into the volume.

6. The system of claim 1, wherein the first and second sides are hingedly connected to the bottom, and the first and second sides can fold inward toward the bottom.

7. The system of claim 6, wherein the first and second sides are sized such that the first and second sides, when folded, do not extend past an edge of the bottom so a plurality of mass containers can be stacked together when empty.

8. The system of claim 1, wherein an edge of the first side or the second side comprises an interlocking feature configured to connect to a second mass container having a similar interlocking feature.

9. The system of claim 1, wherein the bottom further comprises a first hitch, the first hitch configured to connect the first mass container to towing device or to a second mass container.

10. The system of claim 9, wherein the hitch is disposed on the bottom proximate the first side.

11. The system of claim 10, wherein the bottom comprises a second hitch located proximate the second side.

12. The system of claim 1, the first mass container further comprising a computer readable code disposed thereon, the computer readable code being associated with a next destination for the mass container.

13. The system of claim 1, wherein the plurality of trays comprises five layers of 6 trays per layer, and wherein the plurality of trays are contained within the volume.

14. A mass container system comprising:

a first mass container comprising:

a first side, the first side comprising a first indexing feature;

a second side opposite the first side;

a third side;

a fourth side opposite the third side, wherein the third and fourth sides are moveably connected to the first side and the second side;

a bottom connected to the first side and the second side, the bottom comprising a second indexing feature configured to interact with the first indexing feature on a first side of another mass container to allow stacking of mass containers; and wherein the first side, the second side, the third side, and the fourth side are arranged to bound a volume, the volume configured to receive and contain a plurality of trays, the plurality of trays comprising five layers of 6 trays per layer.

* * * * *